US009449517B2

(12) United States Patent
Chiba et al.

(10) Patent No.: US 9,449,517 B2
(45) Date of Patent: Sep. 20, 2016

(54) DRIVING SUPPORT DEVICE, VEHICLE, AND CONTROL PROGRAM

(71) Applicant: HONDA MOTOR CO., LTD., Tokyo (JP)

(72) Inventors: Takeshi Chiba, Wako (JP); Toru Saito, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/507,969

(22) Filed: Oct. 7, 2014

(65) Prior Publication Data

US 2015/0100178 A1 Apr. 9, 2015

(30) Foreign Application Priority Data

Oct. 9, 2013 (JP) ..... 2013-212252

(51) Int. Cl.
*G08G 1/16* (2006.01)

(52) U.S. Cl.
CPC ..... *G08G 1/161* (2013.01)

(58) Field of Classification Search
CPC .. B60W 30/08; B60W 30/09; B60W 30/095; B60W 30/0953; G08G 1/16; G08G 1/161; G08G 1/163; G08G 1/166
See application file for complete search history.

(56) References Cited

U.S. PATENT DOCUMENTS 7,124,027 B1 * 10/2006 Ernst, Jr. ..... B60W 30/09 340/435
8,169,338 B2 * 5/2012 Mudalige ..... G08G 1/163 340/438
9,109,906 B2 * 8/2015 Sakai ..... B60W 30/09
2002/0185324 A1 * 12/2002 Campbell ..... B60R 21/013 180/271
2007/0021915 A1 * 1/2007 Breed ..... B60N 2/2863 701/301
2009/0121918 A1 * 5/2009 Shirai ..... G01S 7/023 342/159

(Continued)

FOREIGN PATENT DOCUMENTS

JP 2005-082124 A 3/2005
JP 2007-233864 A 9/2007

(Continued)

OTHER PUBLICATIONS

Notification of Reasons for Rejection dated Sep. 24, 2015, issued in counterpart Japanese Patent Application No. 2013-212252 (4 pages).

(Continued)

*Primary Examiner* — Jerrah Edwards
*Assistant Examiner* — Tamara Weber
(74) *Attorney, Agent, or Firm* — Westerman, Hattori, Daniels & Adrian, LLP

(57) ABSTRACT

There is provided a driving support device includes a communication unit configured to perform communication with another vehicle; a storage unit configured to store reference information including information regarding positional relationship of the another vehicle with respect to an own-vehicle, information regarding a direction of relative displacement of the another vehicle with respect to the own-vehicle, and a control threshold value, each associated with one another; and a control unit configured to perform predetermined safety control based on whether or not information derived from running information on the another vehicle received by the communication unit and running information on the own-vehicle correspond to the reference information stored by the storage unit.

12 Claims, 28 Drawing Sheets

(56) References Cited

U.S. PATENT DOCUMENTS

| | | | | |
|---|---|---|---|---|
| 2010/0235035 | A1* | 9/2010 | Nishira | B60T 7/22 701/31.4 |
| 2012/0086582 | A1* | 4/2012 | Durekovic | G08G 1/0112 340/903 |
| 2013/0226432 | A1* | 8/2013 | Tsuruta | B60W 30/165 701/96 |

FOREIGN PATENT DOCUMENTS

| | | | |
|---|---|---|---|
| JP | 2008-210198 | A | 9/2008 |
| JP | 2012-022671 | A | 2/2012 |
| JP | 2012-85202 | A | 4/2012 |

OTHER PUBLICATIONS

Office Action dated Mar. 1, 2016, issued in counterpart Japanese Patent Application No. 2013-212252, with English translation. (9 pages).

Office Action dated Jul. 12, 2016, issued in counterpart Japanese Patent Application No. 2013-212252, with English translation. (8 pages).

* cited by examiner

FIG. 22

55

| PARAMETER | PARAMETER VALUE SETTING |
| --- | --- |
| RANGE OF RELATIVE MOVING AZIMUTH OF ANOTHER VEHICLE | −10° TO 10° WHEN REFERENCE AZIMUTH IS ASSUMED TO BE 0° |
| RELATIVE DISTANCE RANGE OF ANOTHER VEHICLE | 200 [m] |
| ... | ... |

DRIVING SUPPORT DEVICE, VEHICLE, AND CONTROL PROGRAM

CROSS REFERENCES TO RELATED APPLICATIONS

The present application claims priority under 35 U.S.C. $119 to Japanese Patent Application No. 2013-212252, filed Oct. 9, 2013, entitled "Driving Support Device, Vehicle, and Control Program." The contents of this application are incorporated herein by reference in their entirety.

TECHNICAL FIELD

The present disclosure relates to a driving support device, a vehicle, and a control program.

BACKGROUND

In recent years, research and development of control technology are being carried out, the control technology for performing various control operations for supporting the safety of a driver by utilizing vehicle-to-vehicle communication to be performed between vehicles and/or road-to-vehicle communication to be performed between a communication device installed on the roadside and a vehicle.

Regarding to this, an information providing system for vehicles is known that includes a transmission source vehicle and a target vehicle, the transmission source vehicle being configured to detect a target vehicle which may be a potential obstacle to own-vehicle, by performing vehicle-to-vehicle communication with another vehicle, the target vehicle being configured to transmit information on own-vehicle to the transmission source by performing vehicle-to-vehicle communication with the transmission source vehicle, to detect the intention of a driver of own-vehicle to decelerate the own-vehicle, and to transmit a result of the detection to the transmission source vehicle (see, for example, Japanese Unexamined Patent Application Publication No. 2008-210198). The information providing system for vehicles sets a timing for providing the information on the target vehicle to a driver based on the detection result received by the transmission source vehicle from the target vehicle, and thus it is possible to provide the information to a driver at an appropriate timing.

Also, a radio communication device is known that is capable of transmitting and receiving vehicle information and position information, the vehicle information regarding own-vehicle and/or another vehicle obtained by vehicle-to-vehicle communication and/or road-to-vehicle communication, the position information being expressed in terms of the latitude and longitude regarding the vehicle information (see, for example, Japanese Unexamined Patent Application Publication No. 2012-085202). The radio communication device allows a transmission source vehicle to reduce at least part of the information of the latitude and longitude of own-vehicle and to transmit the reduced part of the information to a target vehicle which is a vehicle on the receiving side. The target vehicle then restores the received information of the latitude and longitude of the transmission source vehicle. In this manner, the radio communication device may achieve high-speed vehicle-to-vehicle communication and road-to-vehicle communication.

However, in the related art, no consideration is given to appropriate selection of a target vehicle which may be a potential obstacle to own-vehicle. For this reason, the accuracy in safety control may not be sufficient.

SUMMARY

Thus, the present disclosure has been made in view of the problem of the above-described related art, and it would be preferable provide a driving support device, a vehicle, and a control program that are capable of performing safety control based on the positional relationship with another vehicle more accurately.

A first aspect of the present disclosure provides a driving support device (1, 2, 3) including: a communication unit (10) configured to perform communication with another vehicle; a storage unit (50) configured to store reference information including information regarding positional relationship of the another vehicle with respect to an own-vehicle, information regarding a direction of relative displacement of the another vehicle with respect to the own-vehicle, and a control threshold value, each associated with one another; and a control unit (70) configured to perform predetermined safety control based on whether or not information derived from running information on the another vehicle received by the communication unit (10) and running information on the own-vehicle correspond to any of the reference information stored by the storage unit (50). Thus, safety control based on the positional relationship with another vehicle may be performed more accurately.

A second aspect of the present disclosure provides the driving support device (1, 2) according to the first aspect of the present disclosure, in which the reference information is defined for each of classified patterns of encounter situation between the another vehicle and the own-vehicle, and the control unit (70) performs the predetermined safety control based on the reference information for each pattern of encounter situation. Thus, even in a situation in which map information may not be obtained, it is possible to determine more appropriately whether or not another vehicle and own-vehicle encounter with each other.

A third aspect of the present disclosure provides the driving support device (1, 2) according to the first or second aspect of the present disclosure, in which the information regarding positional relationship in the reference information includes a range of azimuth of the another vehicle as viewed from the own-vehicle and a range of relative distance between the another vehicle and the own-vehicle, and the control unit (70) performs the predetermined safety control when an azimuth and a relative distance of the another vehicle are respectively within the range of azimuth of the another vehicle and the range of relative distance in the information regarding positional relationship, the azimuth and relative distance of the another vehicle being derived from the running information on the another vehicle and the running information on the own-vehicle. Thus, it is possible to reduce failures in safety control such as detecting another vehicle for which there is no possibility of collision with own-vehicle.

A fourth aspect of the present disclosure provides a vehicle including the driving support device (1, 2) according to any one of the first to third aspects of the present disclosure; and a collection unit (30) configured to transmit the running information on the own-vehicle to the driving support device. Thus, safety control based on the positional relationship with another vehicle may be performed more accurately.

A fifth aspect of the present disclosure provides a control program causing a computer to execute: performing communication with another vehicle; storing reference information including information regarding positional relationship of the another vehicle with respect to an own-vehicle, information regarding a direction of relative displacement of the another vehicle with respect to the own-vehicle, and a control threshold value, each associated with one another; and performing predetermined safety control based on whether or not information derived from running information on the another vehicle received in the performing communication and running information on the own-vehicle correspond to any of the stored reference information. Thus, safety control based on the positional relationship with another vehicle may be performed more accurately. In the above explanation of the exemplary embodiment, specific elements with their reference numerals are indicated by using brackets. These specific elements are presented as mere examples in order to facilitate understanding, and thus, should not be interpreted as any limitation to the accompanying claims.

BRIEF DESCRIPTION OF THE DRAWINGS

The advantages of the disclosure will become apparent in the following description taken in conjunction with the following drawings.

FIG. 22 is a table illustrating an example of detection area data 55 stored in the storage unit 50.

DETAILED DESCRIPTION

First Embodiment

Figure 1:
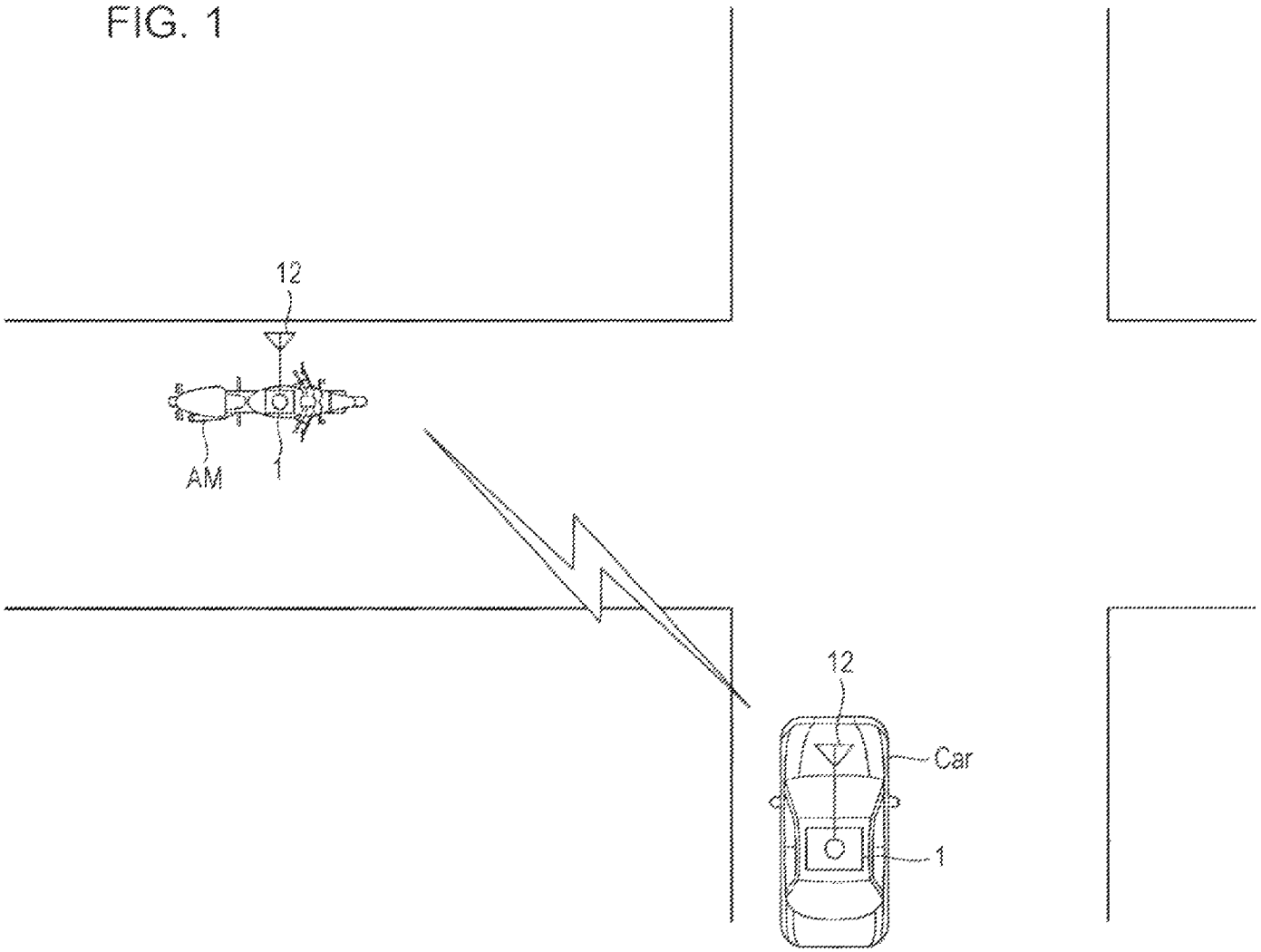
FIG. 1 illustrates an example of a situation in which communication is performed by a driving support device 1 according to a first embodiment.

Hereinafter, a first embodiment of the present disclosure will be described with reference to the accompanying drawings. FIG. 1 illustrates an example of a situation in which communication is performed by a driving support device 1 according to the first embodiment. In FIG. 1, the driving support device 1 is mounted on each of a four-wheel motor vehicle Car and a two-wheel motor vehicle AM, and vehicle-to-vehicle communication is performed via respective antennas 12. It is to be noted that the driving support device 1 is used in the manner in which communication may be performed between the driving support devices both mounted on four-wheel motor vehicles or between the driving support devices both mounted on two-wheel motor vehicles. Also, driving support devices 1 may perform communication indirectly between vehicles by utilizing road-to-vehicle communication via a relay device installed on the roadside. In the following, a description is given by assuming that the driving support devices 1 perform communication directly between vehicles. Such communication is performed in compliance with radio communication standard such as the Institute of Electrical and Electronics Engineers (IEEE) 802.11. However, without being limited to this, communication may be performed in compliance with dedicated communication standard.

Figure 2:
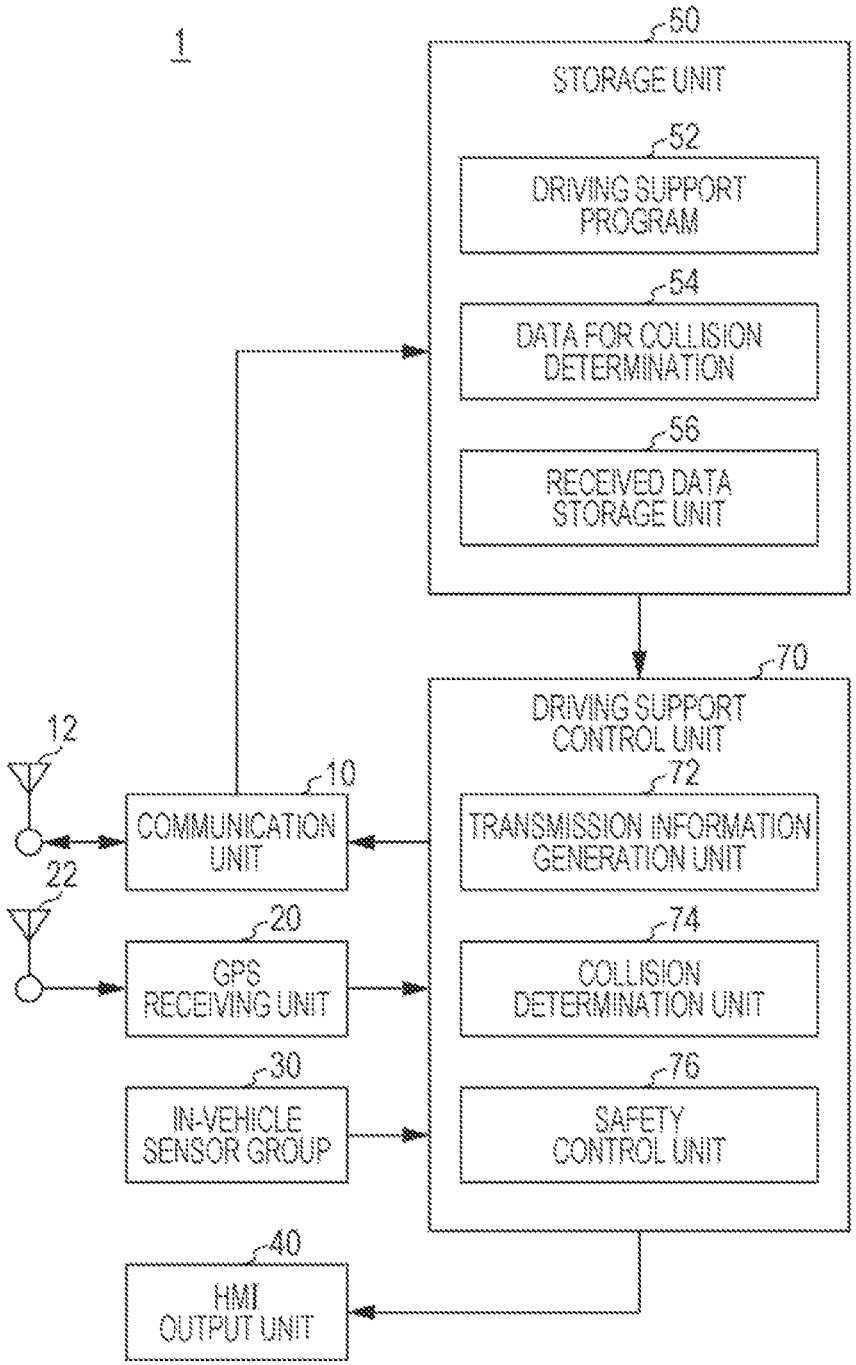
FIG. 2 is a diagram illustrating an exemplary configuration of the driving support device 1 according to the first embodiment.

FIG. 2 is a diagram illustrating an exemplary configuration of the driving support device 1. The driving support device 1 includes, for example, a communication unit 10, a global positioning system (GPS) receiving unit 20, an in-vehicle sensor group 30, a human machine interface (HMI) output unit 40, a storage unit 50, and a driving support control unit 70. The communication unit 10 includes, for example, an antenna 12, a modulation unit, a demodulation unit, and an up/down converter, and performs the vehicle-to-vehicle communication described above. The communication unit 10 allows bidirectional communication via radio communication with another driving support device (for example, another driving support device 1 mounted on the two-wheel motor vehicle AM from the viewpoint of the driving support device 1 mounted on the four-wheel motor vehicle Car illustrated in FIG. 1) mounted on another vehicle, and transmits/receives radio waves via the antenna 12, the radio waves being in a predetermined radio frequency (RF) band which is used for radio communication. Hereinafter, based on the viewpoint of a driving support device 1, own-vehicle refers to the vehicle on which the driving support device 1 is mounted and another vehicle refers to the vehicle on which another driving support device 1 is mounted. The communication unit 10 receives running information on another vehicle from the driving support device 1 mounted on the another vehicle, and causes a received data storage unit 56 of the storage unit 50 to store the received running information. The running information on another vehicle includes, for example, the information indicating the speed, position, and moving azimuth of the another vehicle. In addition, the communication unit 10 transmits the running information on own-vehicle to the driving support device 1 mounted in another vehicle, the running information being generated by a transmission information generation unit 72 of the driving support control unit 70. The running information on own-vehicle includes, for example, the information indicating the speed, position, and moving azimuth of the own-vehicle.

The GPS receiving unit 20 calculates the position (latitude, longitude, and altitude) of own-vehicle based on a navigation message which is obtained by demodulating the signals received by a GPS antenna 22 from a GPS Satellite. The GPS receiving unit 20 transmits the calculated position of own-vehicle to a controller area network (CAN) bus via, for example, a navigation electronic control unit (ECU) which is not illustrated. The ECU is a general term for units that control various electronic devices mounted on a vehicle. The navigation ECU controls a navigation system that provides route guidance to a destination using the own-vehicle's position which is calculated by the GPS receiving unit 20. The CAN is a form of network that allows information sharing between a plurality of control systems of a vehicle by linking the control systems with only a pair of communication lines by multiplex wiring. The CAN bus is multiplex wiring which is used for multiplex communication performed by a CAN.

The in-vehicle sensor group 30 includes, for example, a vehicle speed sensor to detect a speed of own-vehicle, an acceleration sensor to detect an acceleration of own-vehicle, a steering angle sensor to detect a steering angle (which may be any one of the steering angle and the steer angle of a wheel), and a blinker switch to detect a direction of operation of a turn signal (blinker). The various sensors included in the in-vehicle sensor group 30 each transmit the detected value or state to the CAN bus directly or via the ECU. The HMI output unit 40 includes, for example, a speaker, a buzzer, a display device, and a vibrator.

The storage unit 50 includes, for example, a random access memory (RAM), a register, a hard disk drive (HDD), and/or a solid state drive (SSD). The storage unit 50 stores various programs as a driving support program 52, which are to be executed by a central processing unit (CPU) (not illustrated) of the driving support device 1. In addition, the storage unit 50 stores data 54 for collision determination, the data being utilized by the below-described driving support control unit 70 for various types of determination. Furthermore, the storage unit 50 includes the received data storage unit 56 that temporarily stores data which has been received by the communication unit 10. It is to be noted that the data 54 for collision determination may be pre-registered or may be set later by a user.

Figure 3:
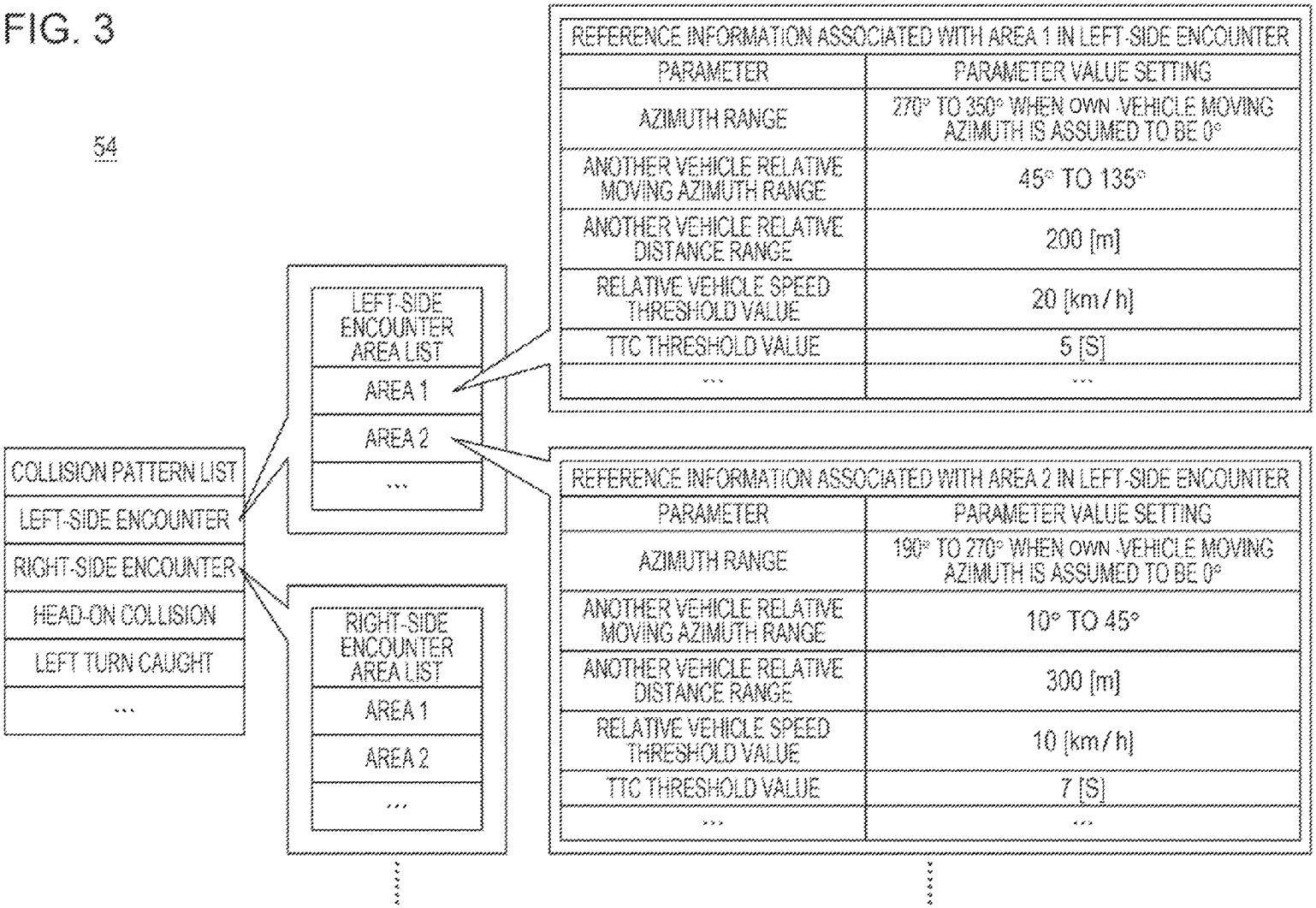
FIG. 3 is a chart illustrating an example of data 54 for collision determination which is stored in a storage unit 50.

In the following, the data 54 for collision determination will be described with reference to FIG. 3. FIG. 3 is a chart illustrating an example of the data 54 for collision determination which is stored in the storage unit 50. The data 54 for collision determination has a hierarchical structure as illustrated, and each of various collision patterns is associated with the reference information described below. The collision patterns are classified patterns of situation of collision which may occur between own-vehicle and another vehicle, and include "left-side encounter" and "right-side encounter" in the example of FIG. 3. The leftmost table in FIG. 3 illustrates the list of collision patterns. The collision patterns are divided into a plurality of areas according to the range of the azimuth of another vehicle with respect to own-vehicle. Each of the areas is associated with "reference information" which is used as a reference to determine whether or not safety control in relation to another vehicle is needed. The rightmost tables in FIG. 3 illustrate the reference information associated with "area 1 associated with left-side encounter" and the reference information associated with "area 2 associated with left-side encounter". In this manner, the data 54 for collision determination has three-layered hierarchical data structure including information indicating collision patterns, information indicating areas, and information indicating each area that indicates a range of the azimuth of another vehicle.

Returning to FIG. 2, the driving support control unit 70 includes, for example, the transmission information generation unit 72, the collision determination unit 74, and a safety control unit 76. Part or all of these functional units are achieved, for example, by the CPU (not illustrated) executing the driving support program 52 stored in the storage unit 50. It is to be noted that part or all of these functional units may be a hardware functional unit such as a large scale integration (LSI) or an application specific integrated circuit (ASIC). The driving support control unit 70 obtains information indicating the position of own-vehicle from the GPS receiving unit 20 and obtains information indicating the speed of own-vehicle and information indicating the acceleration of own-vehicle from the in-vehicle sensor group 30. The transmission information generation unit 72 generates running information on own-vehicle including the moving azimuth, position, and speed of own-vehicle, based on the position and acceleration obtained from the GPS receiving unit 20 and the in-vehicle sensor group 30, and controls the communication unit 10 so that the generated running information on own-vehicle is transmitted to another vehicle.

The collision determination unit 74 determines whether or not there is a possibility of collision between another vehicle and own-vehicle based on the running information on another vehicle obtained from the received data storage unit 56, the running information on own-vehicle obtained from the GPS receiving unit 20 and the in-vehicle sensor group 30, and the data 54 for collision determination stored in the storage unit 50. The details of this determination processing will be described later. The collision determination unit 74 outputs a result of the determination to the safety control unit 76.

The safety control unit 76 performs predetermined safety control based on the result of the determination made by the collision determination unit 74. The predetermined safety control includes, for example, generating a warning sound, causing a braking device to output a braking force, and causing a portion which is in constant contact with a driver to vibrate. In the following description, it is assumed that the safety control unit 76 causes the HMI output unit 40 to generate a warning sound as the predetermined safety control, the warning sound warning a own-vehicle's driver of approach of another vehicle to own-vehicle.

Figure 4:
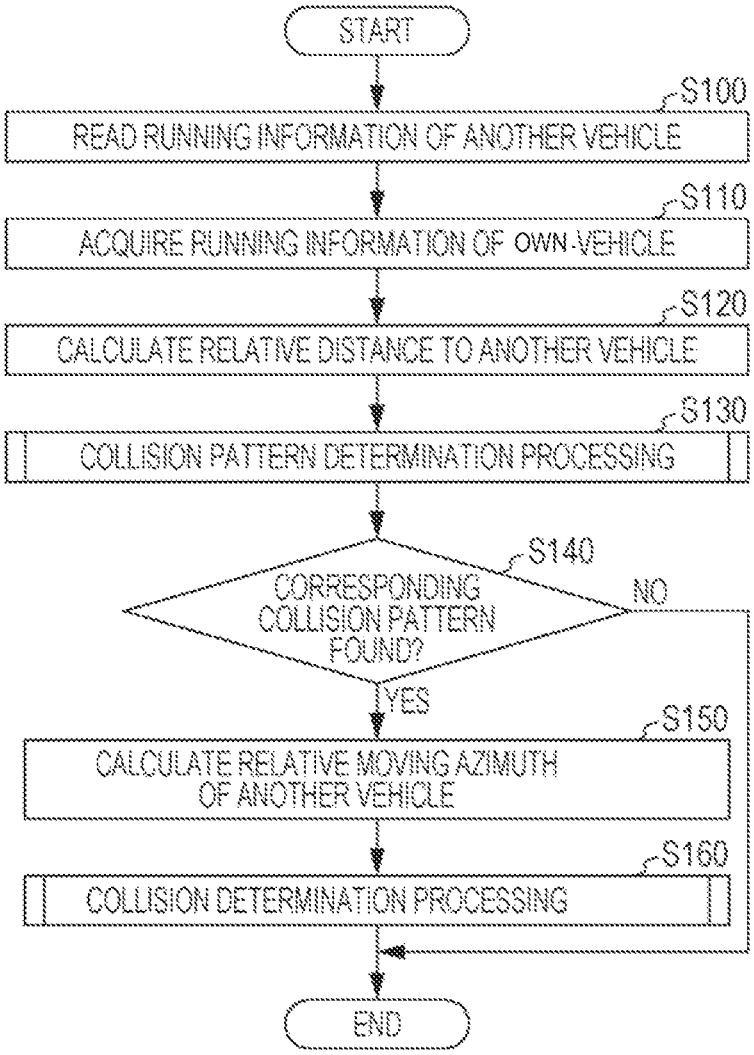
FIG. 4 is a flow chart illustrating an exemplary operation related to determination made by a collision determination unit 74.

FIG. 4 is a flow chart illustrating an exemplary flow of determination processing performed by the collision determination unit 74. First, the collision determination unit 74 reads the running information on another vehicle which is stored in the received data storage unit 56 (step S100). Next, the collision determination unit 74 obtains from the in-vehicle sensor group 30 information indicating the position of own-vehicle, information indicating the speed of own-vehicle, and information indicating the acceleration of own-vehicle (running information on own-vehicle) (step S110). Next, the collision determination unit 74 calculates another vehicle relative distance which is a distance of another vehicle relative to own-vehicle, based on the running information on another vehicle and the running information on own-vehicle (step S120).

Specifically, the collision determination unit 74 calculates another vehicle relative distance based on the position of another vehicle included in the running information on another vehicle and the position of own-vehicle included in the running information on own-vehicle.

Next, the collision determination unit 74 performs collision pattern determination processing. The collision pattern determination processing is the processing of determination as to whether collision which may occur between another vehicle and own-vehicle in the near future corresponds to which one or does not correspond to any of the collision patterns illustrated in FIG. 3, the determination being made based on the relative position or the moving azimuth of another vehicle with respect to own-vehicle (step S130). The details of the collision pattern determination processing will be described later. Next, the collision determination unit 74 determines whether or not it has been determined by the determination in step S130 that a corresponding collision pattern is present (step S140). When it is determined that no corresponding collision pattern is present (No in step S140), there is no possibility of collision of another vehicle with own-vehicle, and thus the collision determination unit 74 terminates the processing. On the other hand, when it is determined that a corresponding collision pattern is present (Yes in step S140), there is a possibility of collision of another vehicle with own-vehicle, and thus the collision determination unit 74 calculates a relative moving azimuth of another vehicle (step S150) based on the running information on another vehicle and the running information on own-vehicle, and determines a relative relationship between another vehicle and own-vehicle in a more detailed manner in the collision determination processing in step S160. Next, the collision determination unit 74 determines whether or not the possibility of collision of another vehicle with own-vehicle is high based on the collision pattern obtained as a result of the determination in step S130 and the calculated relative moving azimuth of another vehicle (collision determination processing) (step S160). The details of the collision determination processing will be described later.

Figure 5:
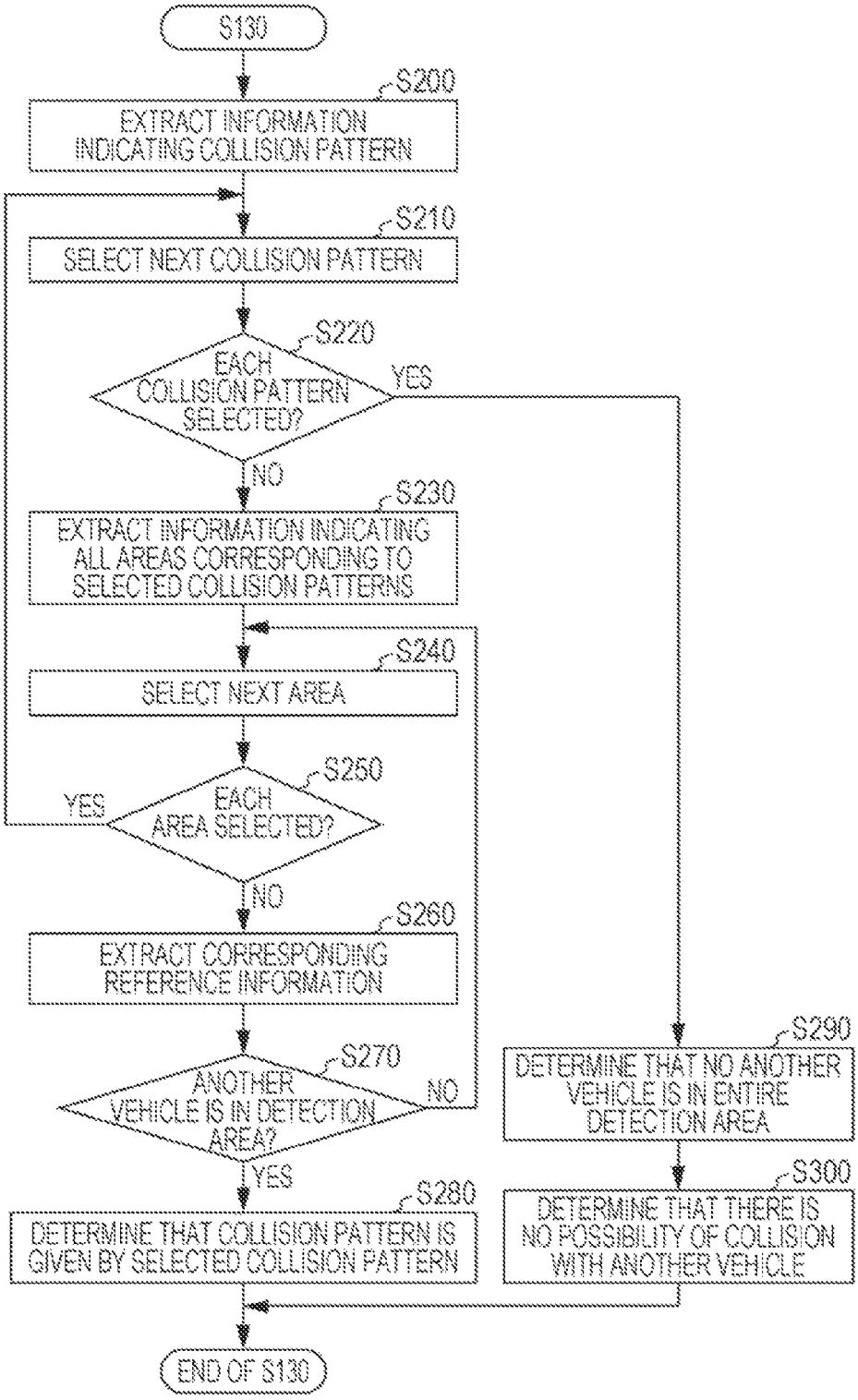
FIG. 5 is a flow chart illustrating an exemplary flow of collision pattern determination processing performed by the collision determination unit 74.

FIG. 5 is a flow chart illustrating an exemplary flow of collision pattern determination processing performed by the collision determination unit 74. The processing of the flow chart illustrated in FIG. 5 illustrates the detailed steps of the collision pattern determination processing in step S130 in the flow chart illustrated in FIG. 4. First, the collision determination unit 74 reads the data 54 for collision determination from the storage unit 50, and extracts the information indicating all collision patterns (step S200). Next, the collision determination unit 74 selects one of unselected collision patterns one by one from the collision patterns obtained in step S200 (step S210). Next, the collision determination unit 74 determines whether or not each collision pattern has been selected (no further selection is made) in step S210 (step S220). When it is determined that each collision pattern has been selected (Yes in step S220), the collision determination unit 74 determines that collision, which may occur between another vehicle and own-vehicle in the near future, does not correspond to any of the collision patterns illustrated in FIG. 3 (step S290), and further determines that there is no possibility of collision between another vehicle and own-vehicle (step S300).

On the other hand, when it is determined that unselected collision pattern is present (No in step S220), the collision determination unit 74 extracts from the data 54 for collision determination information indicating all areas associated with the collision pattern selected in step S210, the information being read from the storage unit 50 (step S230). These areas are such that each of the collision patterns is divided into a plurality of areas according to the range of the azimuth of another vehicle with respect to own-vehicle, and give the information illustrated in the middle tables of FIG. 3. It is to be noted that the information indicating these areas is used as linking information that associates a collision pattern with reference information, and a collision pattern may be directly associated with reference information.

Next, the collision determination unit 74 selects one of unselected areas one by one from the areas extracted in step S230 (step S240). Next, the collision determination unit 74 determines whether or not each area has been selected in step S240 (step S250). When it is determined that each area has been selected (Yes in step S250), the flow proceeds to step S210 and the collision determination unit 74 selects the next collision pattern. On the other hand, when it is determined that unselected area is present (No in step S250), the collision determination unit 74 extracts reference information from the data 54 for collision determination which is read from the storage unit 50, the reference information being associated with the area selected in step S240 (step S260). The reference information is given by the information indicated in the rightmost tables of FIG. 3.

Next, the collision determination unit 74 determines whether or not the relative positional relationship between another vehicle and own-vehicle corresponds to the area selected in step S240, based on the respective positions included in the running information on another vehicle and the running information on own-vehicle, the another vehicle relative distance calculated in step S120 illustrated in FIG. 4, and the reference information extracted in step S260 (step S270). More specifically, the collision determination unit 74 determines whether or not the position of another vehicle with respect to the position of own-vehicle, and another vehicle relative distance are included in the area specified by the azimuth range and another vehicle relative distance range which are included in the reference information illustrated in FIG. 3. When it is determined that another vehicle is included in the area specified by the azimuth range and another vehicle relative distance range, the collision determination unit 74 determines that the relative positional relationship between another vehicle and own-vehicle corresponds to the area selected in step S240. When it is determined that the relative positional relationship does not correspond to the selected area (No in step S270), the flow proceeds to step S240 and the collision determination unit 74 selects the next area. On the other hand, when it is determined that the relative positional relationship between another vehicle and own-vehicle corresponds to the area selected in step S240 (Yes in step S270), the collision determination unit 74 determines that collision, which may occur between another vehicle and own-vehicle in the near future, corresponds to the collision pattern which is associated with the area selected in step S240 (step S280).

Figure 6:
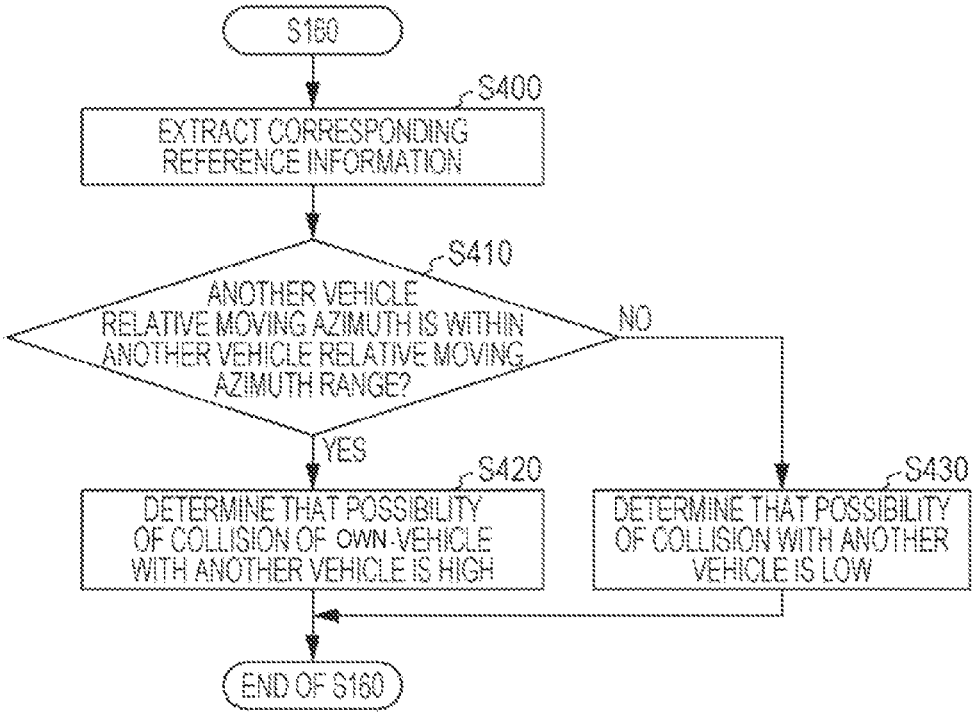
FIG. 6 is a flow chart illustrating an exemplary flow of collision determination processing performed by the collision determination unit 74.

FIG. 6 is a flow chart illustrating an exemplary flow of collision determination processing performed by the collision determination unit 74. The processing of the flow chart illustrated in FIG. 6 illustrates the detailed steps of the collision determination processing in step S160 of the flow chart illustrated in FIG. 4. First, the collision determination unit 74 extracts reference information from the data 54 for collision determination obtained from the storage unit 50, the reference information being associated with the collision pattern which is determined in step S280 illustrated in FIG. 5, the collision pattern corresponding to a pattern of collision which may occur between another vehicle and own-vehicle in the near future (step S400). Next, the collision determination unit 74 determines whether or not the another vehicle relative moving azimuth calculated in step S150 illustrated in FIG. 4 is within the another vehicle relative moving azimuth range which is extracted in step S400 (step S410). When the another vehicle relative moving azimuth is determined to be within the another vehicle relative moving azimuth range (Yes in step S410), the collision determination unit 74 determines that the possibility of collision of another vehicle with own-vehicle is high. On the other hand, when it is determined that the another vehicle relative moving azimuth is determined to be out of the another vehicle relative moving azimuth range (No in step S410), the collision determination unit 74 determines that the possibility of collision of another vehicle with own-vehicle is low (step S430).

Figure 7:
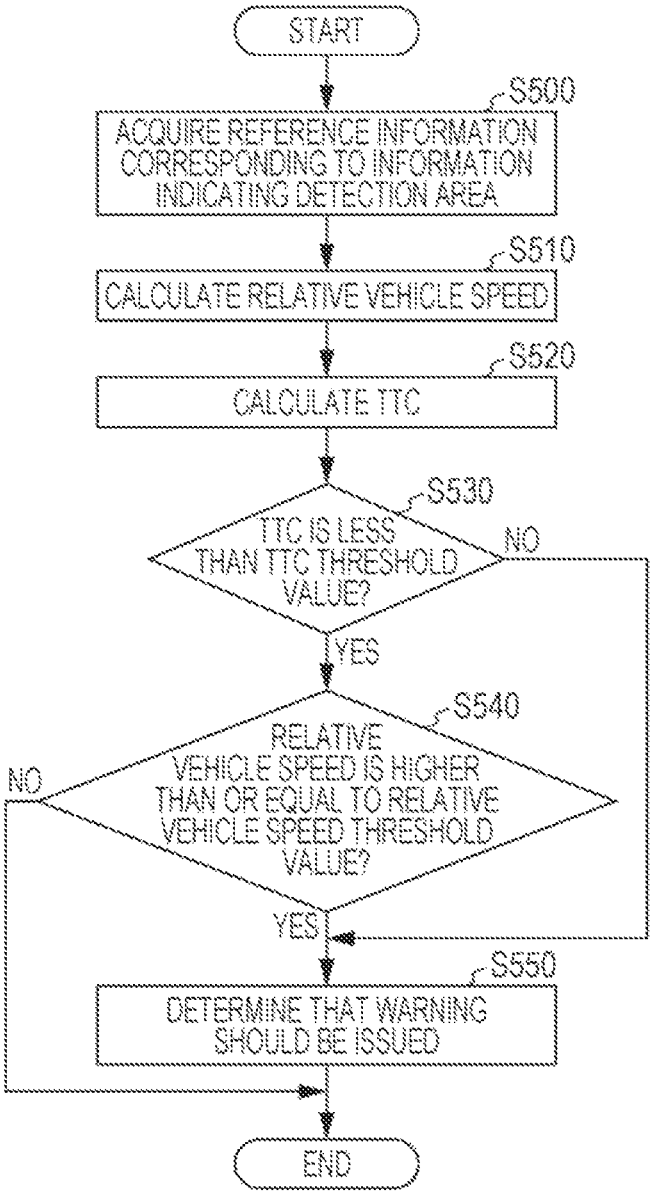
FIG. 7 is a flow chart illustrating an exemplary flow of determination processing made by the collision determination unit 74 as to whether or not predetermined safe control is performed by a safety control unit 76 in the case where the possibility of collision between another vehicle and own-vehicle is determined to be high in step S160 illustrated in FIG. 4.

FIG. 7 is a flow chart illustrating an exemplary flow of determination processing made by the collision determination unit 74 as to whether or not predetermined safe control is performed by the safety control unit 76 in the case where the possibility of collision between own-vehicle and another vehicle is determined to be high in the flow chart illustrated in FIG. 6. First, the collision determination unit 74 again extracts the reference information extracted in step S400 illustrated in FIG. 6 from the data 54 for collision determination obtained from the storage unit 50 (step S500). Next, the collision determination unit 74 calculates a relative vehicle speed between own-vehicle and another vehicle based on the running information on another vehicle and the running information on own-vehicle respectively obtained from the received data storage unit 56 and the driving support control unit 70 (step S510). Next, the collision determination unit 74 calculates a time to collision (TTC) based on the running information on another vehicle and the running information on own-vehicle (step S520). TTC is a value of predicted time that is left until own-vehicle collides with another vehicle under the assumption that the current relative vehicle speed is maintained, and the TTC is determined by dividing the relative distance by the relative vehicle speed.

Next, the collision determination unit 74 determines whether or not the TTC calculated in step S520 is less than a TTC threshold value included in the reference information extracted in step S500 (step S530). When the TTC is determined to be less than the TTC threshold value (Yes in step S530), sufficient time is not left until another vehicle collides with own-vehicle, and thus the collision determination unit 74 determines that predetermined safety control needs to be performed (step S550). On the other hand, when the TTC is determined to be not less than the TTC threshold value (No in step S530), although another vehicle approaching own-vehicle, sufficient time is left until another vehicle collides with own-vehicle, and thus the collision determination unit 74 determines whether or not the relative vehicle speed is higher than or equal to a relative vehicle speed threshold value (step S540). When it is determined that the relative vehicle speed is higher than or equal to the relative vehicle speed threshold value (Yes in step S540), the time left until collision occurs between own-vehicle and another vehicle may be reduced due to an increase in the relative vehicle speed, and thus the collision determination unit 74 determines that predetermined safety control needs to be performed. On the other hand, when it is determined that the relative vehicle speed is lower than the relative vehicle speed threshold value (No in step S540), the possibility of collision of another vehicle with own-vehicle is low, and thus the collision determination unit 74 determines that predetermined safety control does not need to be performed, and terminates the processing.

Figure 8:
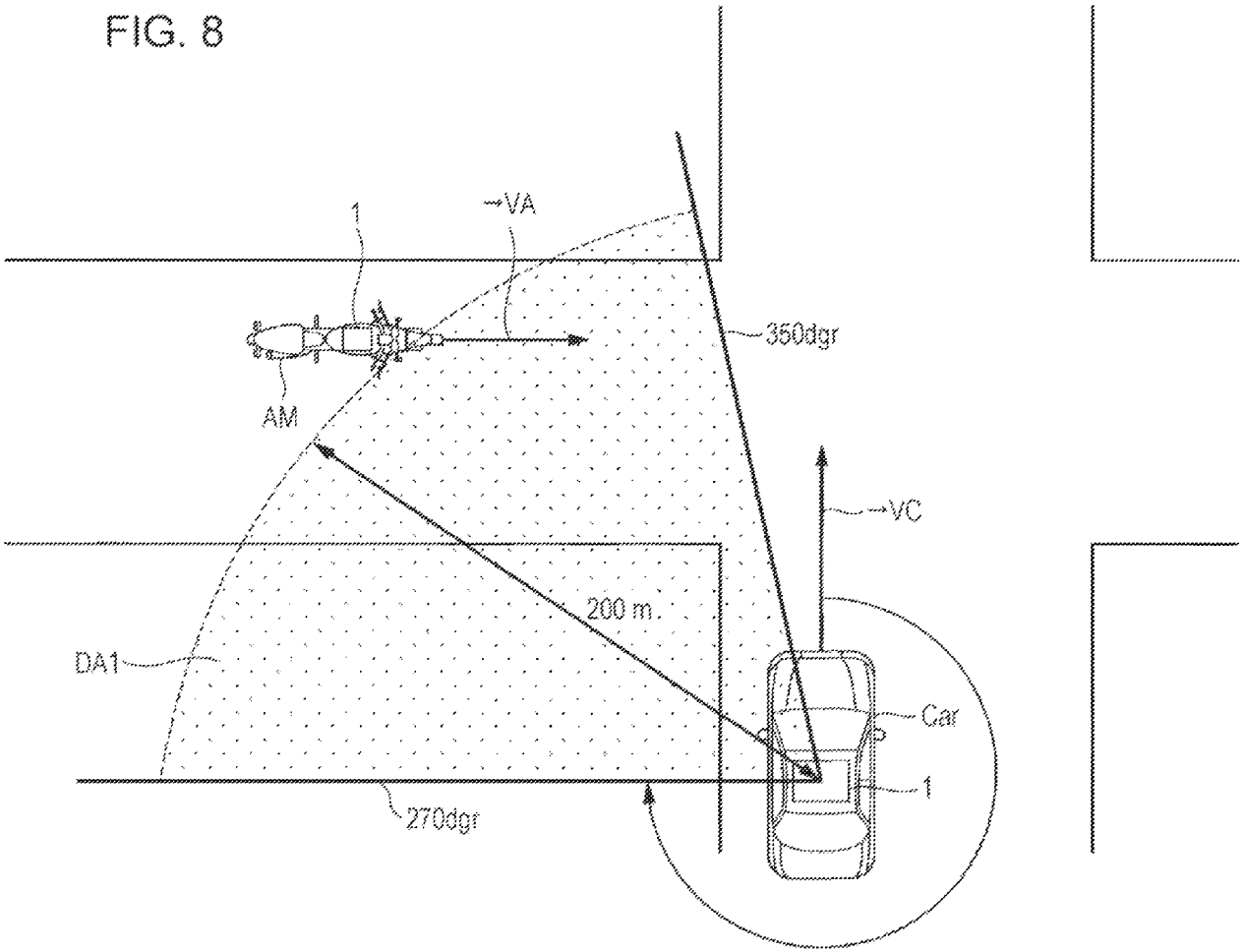
FIG. 8 illustrates an example of a situation in which predetermined safe control is performed by the driving support device 1 of own-vehicle when another vehicle is approaching own-vehicle.

FIG. 8 illustrates an example of a situation in which predetermined safe control is performed by the driving support device 1 of own-vehicle when another vehicle is approaching own-vehicle. In the situation illustrated in FIG. 8, two-wheel motor vehicle AM (another vehicle) is approaching from the left with respect to the moving direction of the motor vehicle Car (own-vehicle). The motor vehicle Car has the mounted driving support device 1 as own-vehicle, and is moving with the direction and speed indicated by a velocity vector →VC. In the following, "→" indicates that the subsequent character represents a vector. Also, two-wheel motor vehicle AM has the mounted driving support device 1 as another vehicle, and is moving with the direction and speed indicated by a velocity vector →VA.

In the situation of FIG. 8, "another vehicle relative moving azimuth" in FIG. 3 is the direction of 90° clockwise under the assumption that the moving azimuth (the azimuth indicated by the velocity vector →VC illustrated in FIG. 8) of the motor vehicle Car is 0°. A thick line 270 dgr indicates the direction that extends in the direction of 270° clockwise from the motor vehicle Car under the assumption that the moving azimuth of the motor vehicle Car is 0°. Similarly, a thick line 350 dgr indicates the direction that extends in the direction of 350° clockwise from the motor vehicle Car under the assumption that the moving azimuth of the motor vehicle Car is 0°. An area DA1 is the area of sector which is defined between the thick line 270 dgr and the thick line 350 dgr and has a distance 200 [m] or less from the motor vehicle Car. In FIG. 8, the area DA1 is indicated by hatching. The area DA1 is the area which is specified by the reference information of the area 1 in the left-side encounter illustrated in FIG. 3. That is, the area DA1 is the area which is specified by the azimuth range and the another vehicle relative distance range.

The collision determination unit 74 determines whether or not the two-wheel motor vehicle AM has entered the area DA1 based on the running information on the motor vehicle Car (own-vehicle), the running information on the two-wheel motor vehicle AM (another vehicle), and the reference information illustrated in FIG. 3, thereby determining whether or not there is a possibility of collision between the two-wheel motor vehicle AM and the motor vehicle Car. When it is determined that the two-wheel motor vehicle AM has entered the area DA1, the collision determination unit 74 calculates another vehicle relative moving azimuth, and determines whether or not the possibility of collision of the two-wheel motor vehicle AM with the motor vehicle Car is high based on the calculated another vehicle relative moving azimuth and the reference information. In the example illustrated in FIG. 8, the another vehicle relative moving azimuth of the two-wheel motor vehicle AM is 90° as described above, and thus is within the another vehicle relative moving azimuth range which is included in the reference information of the area 1 in the left-side encounter illustrated in FIG. 3. Consequently, the collision determination unit 74 calculates the relative vehicle speed of the two-wheel motor vehicle AM with respect to the motor vehicle Car, and determines based on the calculated relative vehicle speed whether or not predetermined safety control is performed.

In this manner, the driving support device 1 in the first embodiment performs predetermined safety control based on whether or not which one of the reference information pieces included in the data 54 for collision determination corresponds to the information derived from the running information on another vehicle received by communication with the another vehicle and the running information on own-vehicle, and thus the driving support device 1 is capable of performing safety control based on the positional relationship with another vehicle more accurately.

In addition, reference information is defined for each of classified patterns of encounter situation between another vehicle and own-vehicle, and the driving support device 1 performs predetermined safety control based on the reference information for each encounter situation, and thus is capable of determining more appropriately whether or not another vehicle and own-vehicle encounter with each other even in a situation in which map information may not be obtained.

Furthermore, the driving support device 1 performs predetermined safety control when the reference information includes the another vehicle relative moving azimuth range and another vehicle relative distance range as viewed from own-vehicle, and the another vehicle relative moving azimuth and another vehicle relative distance derived from the running information on another vehicle and the running information on own-vehicle are respectively within the another vehicle relative moving azimuth range and the another vehicle relative distance range. Thus it is possible to reduce failures in safety control such as detecting another vehicle for which there is no possibility of collision with own-vehicle.

Second Embodiment

Hereinafter, a second embodiment of the present disclosure will be described with reference to the accompanying drawings. A driving support device 2 according to the second embodiment has the below-described new function which is added to the functions of the driving support device 1 according to the first embodiment. When own-vehicle runs at a low speed at the time of low speed turning or stopping after low speed turning, the driving support device 2 determines a more appropriate azimuth as a reference for azimuth range (hereinafter referred to as a reference azimuth) instead of using own-vehicle moving azimuth, the azimuth being one of the reference information pieces included in the data 54 for collision determination illustrated in FIG. 3, and performs various types of determination and predetermined safety control based on the azimuth range which is specified according to the determined azimuth. The details of the determination of an azimuth as a reference azimuth will be described later.

Figure 9:
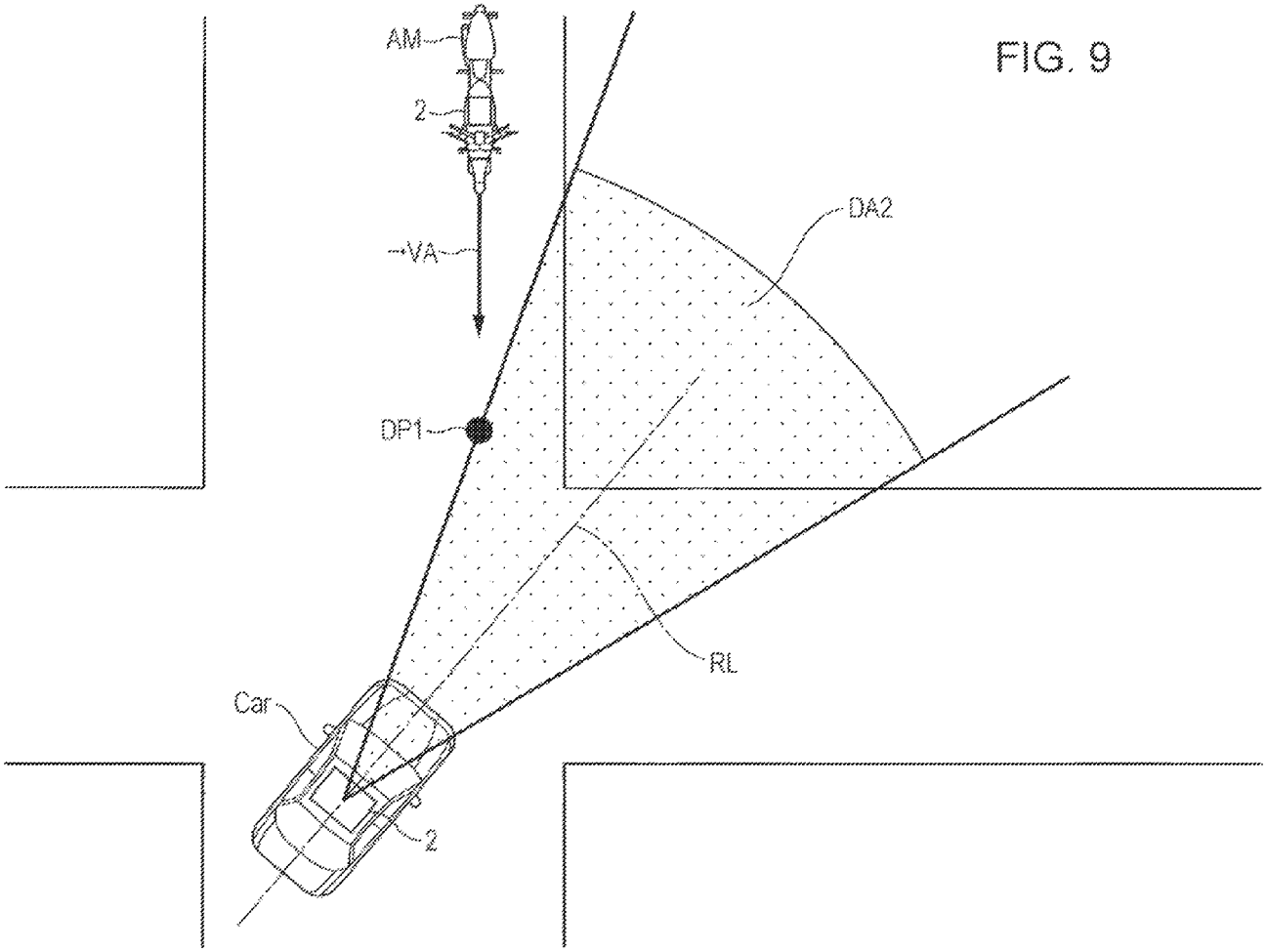
FIG. 9 illustrates an example of a situation in which another vehicle, which is approaching own-vehicle at an intersection, is detected by the driving support device 1 according to the first embodiment in comparison to the case where a driving support device 2 according to a second embodiment is used.

FIG. 9 illustrates an example of a situation in which another vehicle, which is approaching own-vehicle at an intersection, is detected by the driving support device 1 according to the first embodiment in comparison to the case where a driving support device 2 according to a second embodiment is used. Hereinafter, based on the viewpoint of a driving support device 1, own-vehicle refers to the vehicle on which the driving support device 1 is mounted and another vehicle refers to the vehicle on which another driving support device 1 is mounted. In FIG. 9, a motor vehicle Car (own-vehicle) intends to make a right turn at an intersection. The motor vehicle Car has slightly turned at a low speed and stopped to wait for an appropriate timing for making a right turn. Here, an area DA2 is associated with the reference information corresponding to the collision pattern of "head-on collision". In the following, only the control based on the reference information corresponding to the collision pattern of "head-on collision" will be described for the sake of simplicity of description. For other collision patterns, the driving support device 2 according to the second embodiment performs the same processing as that of the driving support device 1 according to the first embodiment.

The area DA2 extends in the direction of a reference line RL which is defined as 0°, the direction being the own-vehicle moving azimuth immediately before the motor vehicle Car stops. The two-wheel motor vehicle AM (another vehicle) is moving in the direction indicated by a velocity vector →VA, and when arrived at a detection point DP1, predetermined safety control is performed by the driving support device 1 mounted on the motor vehicle Car according to the processing flow illustrated in FIGS. 4 to 7.

Figure 10:
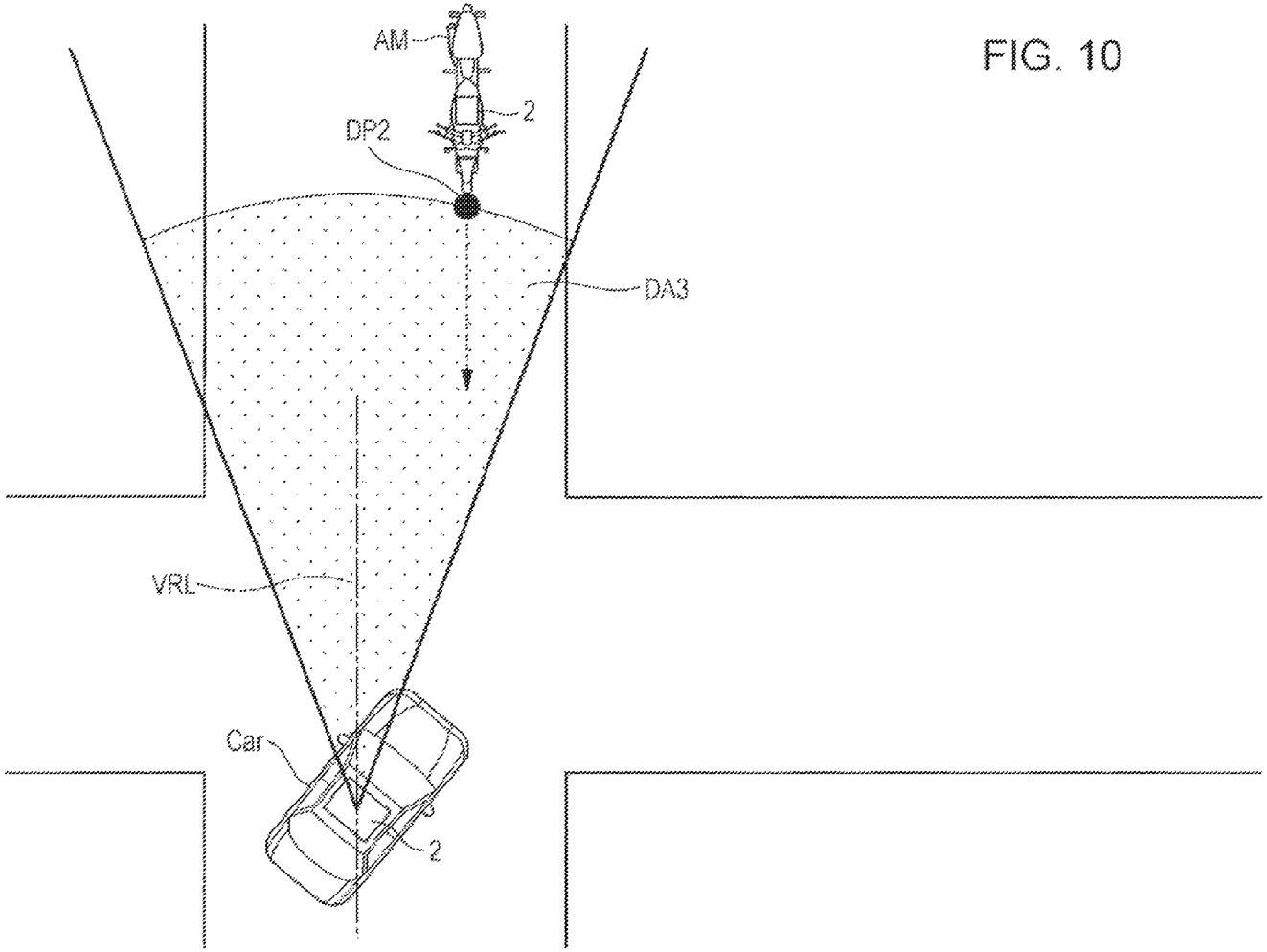
FIG. 10 illustrates an example of a situation in which another vehicle, which is approaching own-vehicle at an intersection, is detected by the driving support device 2 according to the second embodiment.

Here, the difference between the driving support device 1 in the first embodiment illustrated in FIG. 9 and the driving support device 2 in the second embodiment will be described with reference to FIG. 10. FIG. 10 illustrates an example of a situation in which another vehicle, which is approaching own-vehicle at an intersection, is detected by the driving support device 2 according to the second embodiment. Hereinafter, based on the viewpoint of a driving support device 2, own-vehicle refers to the vehicle on which the driving support device 2 is mounted and another vehicle refers to the vehicle on which another driving support device 2 is mounted. In FIG. 10, similarly to FIG. 9, a motor vehicle Car intends to make a right turn at an intersection. The motor vehicle Car has slightly turned at a low speed and stopped to wait for an appropriate timing for making a right turn. Here, although the area DA3 is specified by the reference information corresponding to "head-on collision", unlike the area DA2 illustrated in FIG. 9, the area DA3 extends in the direction of a reference line VRL which is defined as 0°. The direction of the reference line VRL is the azimuth that is determined to be the reference azimuth by the below-described reference azimuth determination unit 73. When the two-wheel motor vehicle AM reaches a detection point DP2, predetermined safety control is performed by the driving support device 2 mounted on the motor vehicle Car according to the processing flow illustrated in FIGS. 4 to 7.

When the example of FIG. 9 is compared with the example of FIG. 10, the detection area of the driving support device 2 illustrated in FIG. 10 is the area (the area along the road on which the two-wheel motor vehicle AM moves) to which more attention should be naturally given. For this reason, when the detection point DP2 in FIG. 10 is compared with the detection point DP1 in FIG. 9, the detection point DP2 is more away from the motor vehicle Car than the detection point DP1 is. Consequently, the driving support device 2 may detect approach of another vehicle at a point more away than the driving support device 1 does, and may perform predetermined safety control for another vehicle at an earlier timing.

Figure 11:
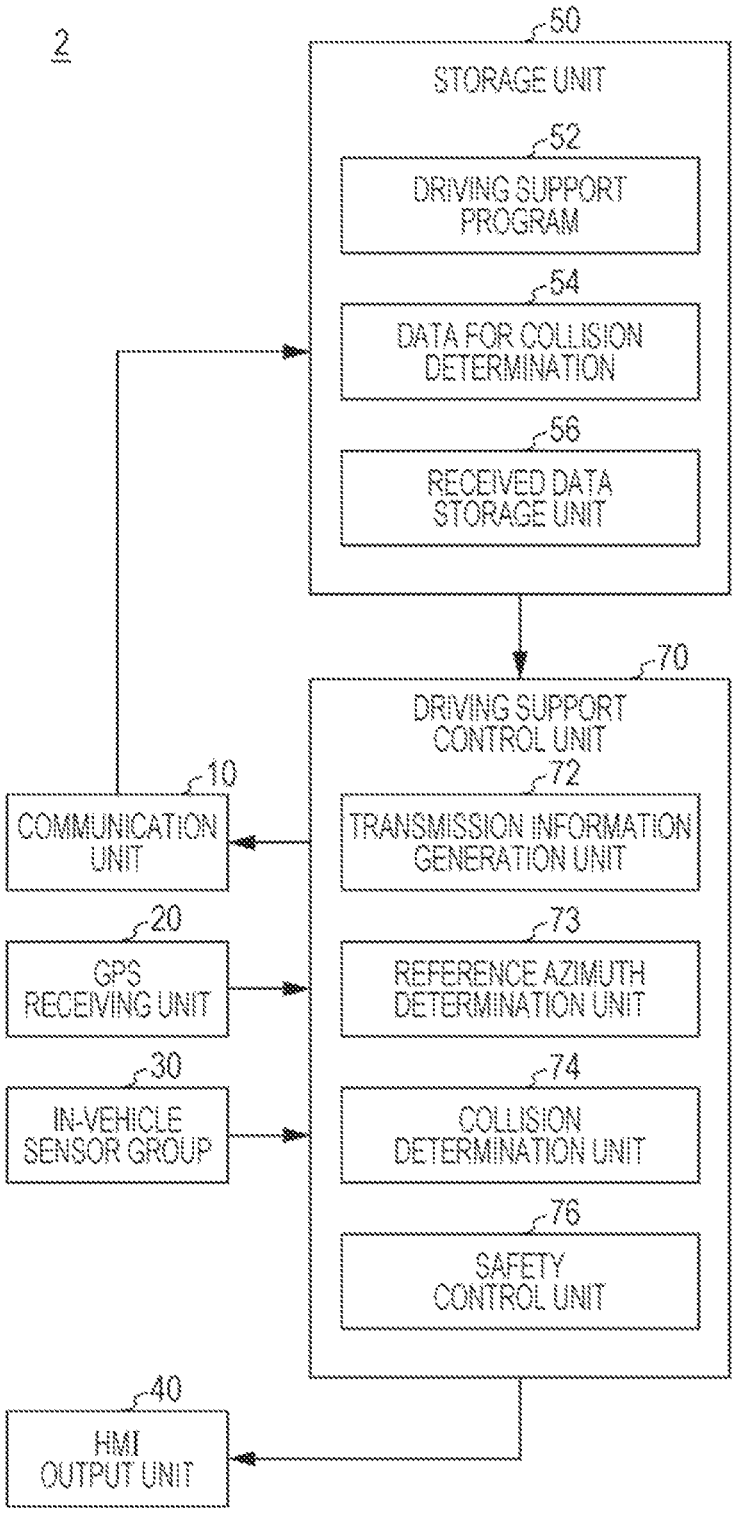
FIG. 11 is a diagram illustrating an exemplary configuration of the driving support device 2 according to the second embodiment.

FIG. 11 is a diagram illustrating an exemplary configuration of the driving support device 2. The driving support device 2 includes, for example, the communication unit 10, the GPS receiving unit 20, the in-vehicle sensor group 30, the HMI output unit 40, the storage unit 50, and the driving support control unit 70. The communication unit 10 includes, for example, the antenna 12, a modulation unit, a demodulation unit, and an up/down converter, and performs communication. The communication unit 10 allows bidirectional communication via radio communication with another driving support device mounted on another vehicle, and transmits/receives radio waves via the antenna 12, the radio waves being in a predetermined RF band which is used for radio communication. The communication unit 10 receives running information on another vehicle from the driving support device 2 mounted on the another vehicle, and causes the received data storage unit 56 of the storage unit 50 to store the received running information. The running information on another vehicle includes, for example, the information indicating the speed, position, and moving azimuth of the another vehicle. Hereinafter, based on the viewpoint of a driving support device 2, own-vehicle refers to the vehicle on which the driving support device 2 is mounted and another vehicle refers to the vehicle on which another driving support device 2 is mounted. In addition, the communication unit 10 transmits the running information on own-vehicle to the driving support device 2 mounted in another vehicle, the running information being generated by the transmission information generation unit 72 of the driving support control unit 70. The running information on own-vehicle includes, for example, information indicating the speed, information indicating the position, and information indicating the moving azimuth of the own-vehicle.

The GPS receiving unit 20 calculates the position (latitude, longitude, and altitude) of own-vehicle based on a navigation message which is obtained by demodulating the signals received by the GPS antenna 22 from a GPS Satellite. The GPS receiving unit 20 transmits the calculated position of the own-vehicle to the CAN bus via, for example, a navigation ECU which is not illustrated.

The in-vehicle sensor group 30 includes, for example, a vehicle speed sensor to detect a speed of own-vehicle, an acceleration sensor to detect an acceleration, a steering angle sensor to detect a steering angle (which may be any one of the steering angle and the steer angle of a wheel), and a blinker switch to detect a direction of operation of the turn signals (blinkers). The various sensors included in the in-vehicle sensor group 30 each transmit the detected value or state to the CAN bus directly or via the ECU. The HMI output unit 40 includes, for example, a speaker, a buzzer, a display device, and a vibrator.

The storage unit 50 includes, for example, a RAM, a register, a HDD, and a SSD. The storage unit 50 stores various programs as driving support program 52, which are to be executed by a CPU (not illustrated) of the driving support device 2. In addition, the storage unit 50 stores data 54 for collision determination, the data being utilized by the below-described driving support control unit 70 for various types of determination. Furthermore, the storage unit 50 includes the received data storage unit 56 that temporarily stores data which has been received by the communication unit 10. It is to be noted that the data 54 for collision determination may be pre-registered or may be set later by a user.

The driving support control unit 70 includes, for example, the transmission information generation unit 72, a reference azimuth determination unit 73, the collision determination unit 74, and the safety control unit 76. Part or all of these functional units are achieved, for example, by the CPU (not illustrated) executing the driving support program 52 stored in the storage unit 50. It is to be noted that part or all of these functional units may be a hardware functional unit such as an LSI or an ASIC. The driving support control unit 70 obtains information indicating the position of own-vehicle from the GPS receiving unit 20 and obtains information indicating the speed of own-vehicle and information indicating the acceleration of own-vehicle from the in-vehicle sensor group 30. The transmission information generation unit 72 generates running information on own-vehicle including the moving azimuth, position, and speed of own-vehicle, based on the position and acceleration obtained from the GPS receiving unit 20 and the in-vehicle sensor group 30, and controls the communication unit 10 so that the generated running information on own-vehicle is transmitted to another vehicle.

The reference azimuth determination unit 73 determines whether or not running of own-vehicle is substantially turning at a low speed, based on the running information on own-vehicle. When it is determined that the running of own-vehicle is not substantially turning at a low speed, the reference azimuth determination unit 73 determines the reference azimuth to be the own-vehicle moving azimuth. When it is determined that the running of own-vehicle is substantially turning at a low speed, the reference azimuth determination unit 73 determines the reference azimuth to be an azimuth having an azimuth angle direction which is opposite to the direction of the turn of own-vehicle with respect to the own-vehicle moving azimuth. The reference azimuth determination unit 73 then outputs the determined reference azimuth to the collision determination unit 74.

The collision determination unit 74 acquires the running information on another vehicle which is obtained from the received data storage unit 56, information indicating the position of own-vehicle, information indicating the speed and acceleration of own-vehicle (running information on own-vehicle) which are obtained from the GPS receiving unit 20 and the in-vehicle sensor group 30, and the reference azimuth which is obtained from the reference azimuth determination unit 73. The collision determination unit 74 reads the data 54 for collision determination from the storage unit 50. The collision determination unit 74 then performs the processing illustrated in FIGS. 4 to 7 based on the obtained running information on other vehicle, the data 54 for collision determination, the running information on own-vehicle obtained from the transmission information generation unit 72, and the reference azimuth. The collision determination unit 74 performs the processing illustrated in FIGS. 4 to 7 using obtained reference azimuths which are an azimuth as a reference for the azimuth range of the obtained data 54 for collision determination and an azimuth as a reference for calculating another vehicle relative moving azimuth.

The safety control unit 76 performs predetermined safety control based on the result of the determination obtained from the collision determination unit 74. The predetermined safety control includes, for example, generating a warning sound, causing a braking device to operate, and causing a portion which is in constant contact with a driver to vibrate. In the following description, it is assumed that the safety control unit 76 causes the HMI output unit 40 to generate a warning sound as predetermined safety control, the warning sound warning a own-vehicle's driver of approach of another vehicle to own-vehicle.

Figure 12:
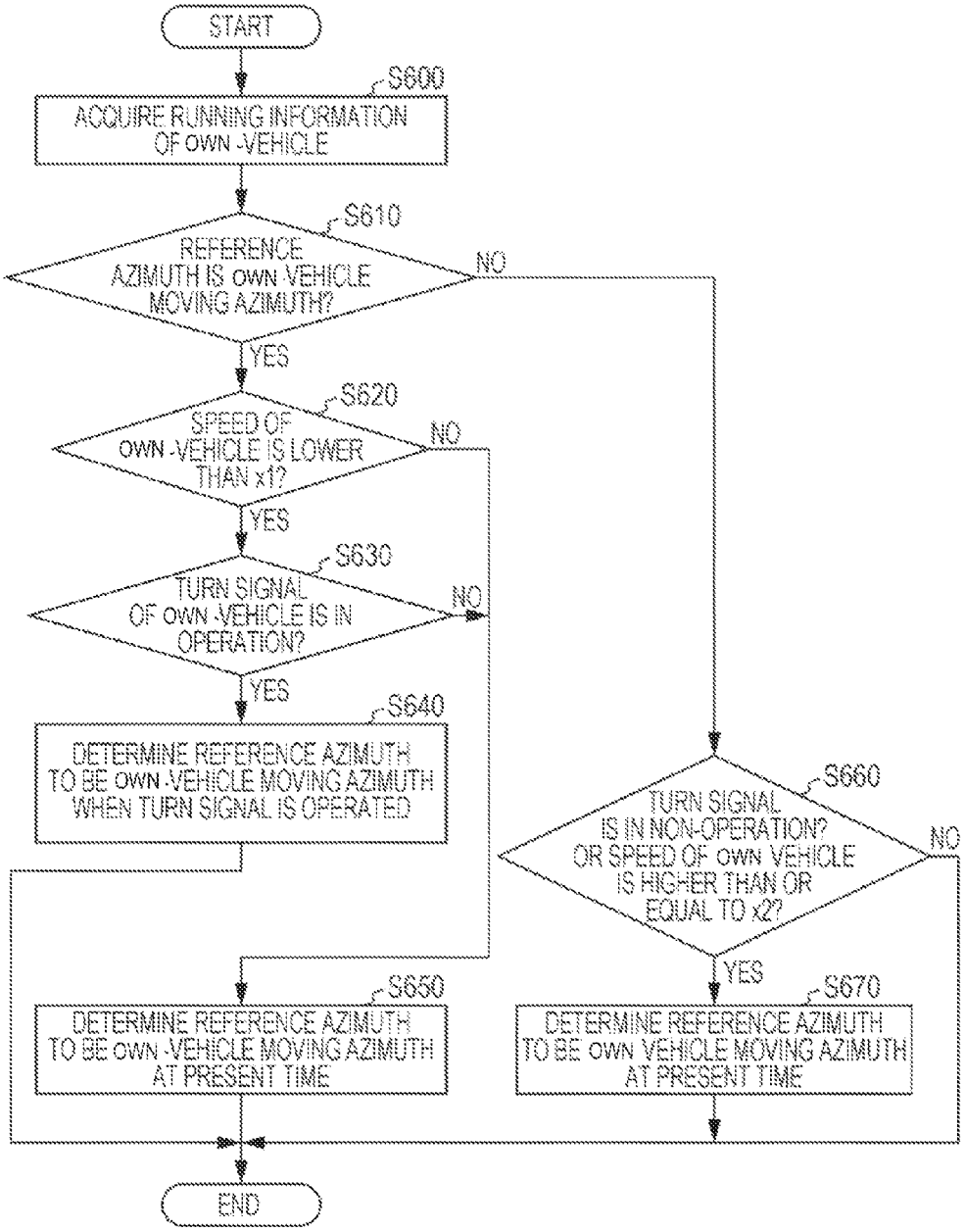
FIG. 12 is a flow chart illustrating an exemplary processing flow of determining a reference azimuth by a reference azimuth determination unit 73.

FIG. 12 is a flow chart illustrating an exemplary processing flow of determining a reference azimuth by the reference azimuth determination unit 73. First, the reference azimuth determination unit 73 obtains information indicating the position of own-vehicle, information indicating the speed of own-vehicle, and information indicating the acceleration of own-vehicle (running information on own-vehicle) from the GPS receiving unit 20 and the in-vehicle sensor group 30 (step S600). Next, the reference azimuth determination unit 73 determines whether or not the reference azimuth determined or held in the last routine is own-vehicle moving azimuth (step S610). When it is determined that the reference azimuth is own-vehicle moving azimuth (Yes in step S610), the reference azimuth determination unit 73 determines whether or not the speed of own-vehicle is lower than a predetermined threshold value x1 (step S620). The predetermined threshold value x1 is a threshold value which is used as a reference for determining whether or not own-vehicle is running at a low speed, and the threshold value is set to approximately 5 [km] per hour, for example. When it is determined that the speed of own-vehicle is not lower than the predetermined threshold value x1 (No in step S620), the reference azimuth determination unit 73 determines the reference azimuth to be the own-vehicle moving azimuth at the present time (step S650), and subsequently terminates the processing. When it is determined that the speed of own-vehicle is lower than the predetermined threshold value x1 (Yes in step S620), the reference azimuth determination unit 73 determines whether or not the turn signal of own-vehicle is in operation (step S630). When it is determined that the turn signal of own-vehicle is in operation (Yes in step S630), the reference azimuth determination unit 73 determines the reference azimuth to be the own-vehicle moving azimuth at the time when the turn signal starts to be operated (step S640), and terminates the processing. Here, "the own-vehicle moving azimuth at the time when the turn signal starts to be operated" is an example of "azimuth having an azimuth angle direction which is opposite to the direction of the turn of own-vehicle with respect to the own-vehicle moving azimuth". For this kind of "azimuth", the below-described "own-vehicle moving azimuth a predetermined time ago", "provisional reference azimuth", or "extending direction of road" may be used in addition to "the own-vehicle moving azimuth at the time when the turn signal starts to be operated". When it is determined that the turn signal of own-vehicle is not in operation (No in step S630), the flow proceeds to step S650 and the reference azimuth determination unit 73 determines the reference azimuth to be the own-vehicle moving azimuth at the present time.

On the other hand, when it is determined that the reference azimuth is not the own-vehicle moving azimuth in step S610 (No in step S610), the reference azimuth determination unit 73 determines whether or not the turn signal is not in operation, or the speed of own-vehicle is higher than or equal to a predetermined threshold value x2 (step S660). The predetermined threshold value x2 is a threshold value which is used as a reference for determining whether or not own-vehicle is running at a low speed, and the threshold value is set to approximately 5 [km] per hour, for example. The predetermined threshold value x2 may be the same value as or a different value from the predetermined threshold value x1. When it is determined that the turn signal is not in operation, or the speed of own-vehicle is higher than or equal to the predetermined threshold value x2 (Yes in step S660), it is highly probable that own-vehicle is no longer running with a low speed turn, and thus the reference azimuth determination unit 73 determines the reference azimuth to be the own-vehicle moving azimuth at the present time (step S670), and terminates the processing. On the other hand, when it is determined that the turn signal is in operation, or the speed of own-vehicle is lower than the predetermined threshold value x2 (No in step S660), it is highly probable that own-vehicle is still running with a low speed turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained.

Figure 13:
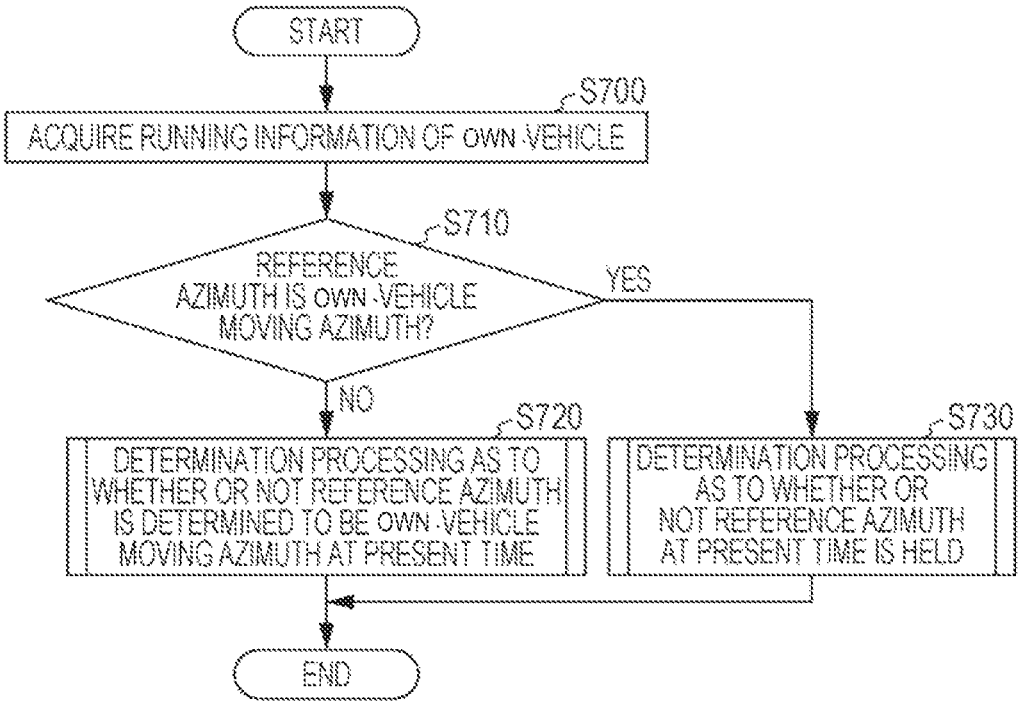
FIG. 13 is a flow chart illustrating another exemplary processing flow of determining a reference azimuth by the reference azimuth determination unit 73.

FIG. 13 is a flow chart illustrating another exemplary processing flow of determining a reference azimuth by the reference azimuth determination unit 73. First, as the running information on own-vehicle, the reference azimuth determination unit 73 obtains information indicating the position of own-vehicle, information indicating the speed of own-vehicle, and information indicating the acceleration of own-vehicle which have been acquired by the driving support control unit 70 (step S700). Next, the reference azimuth determination unit 73 determines whether or not the reference azimuth determined immediately before (at the time of the last processing) is the own-vehicle moving azimuth at the present time (step S710). When it is determined that the reference azimuth is the own-vehicle moving azimuth at the present time (Yes in step S710), the reference azimuth determination unit 73 performs processing of determination as to whether or not the reference azimuth at the present time is held (step S730), and terminates the processing. On the other hand, when it is determined that the reference azimuth is not the own-vehicle moving azimuth at the present time (No in step S710), the reference azimuth determination unit 73 performs processing of determination (step S720) as to whether or not the reference azimuth is determined to be the own-vehicle moving azimuth at the present time, and terminates the processing. The details of the determination as to whether or not the reference azimuth is determined to be the own-vehicle moving azimuth will be described later.

Figure 14:
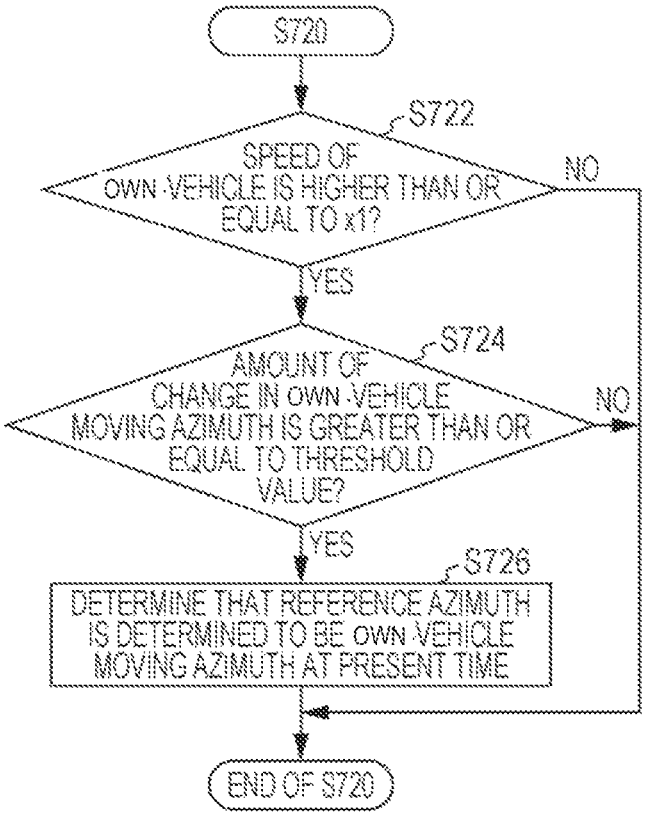
FIG. 14 is a flow chart illustrating an exemplary processing flow of determination made by the reference azimuth determination unit 73 as to whether or not a reference azimuth is determined to be the own-vehicle moving azimuth at the present time.

FIG. 14 is a flow chart illustrating an exemplary processing flow of determination made by the reference azimuth determination unit 73 as to whether or not a reference azimuth is determined to be the own-vehicle moving azimuth at the present time. The processing of the flow chart illustrated in FIG. 14 illustrates the detailed steps of the processing of determination as to whether or not the reference azimuth is determined to be the own-vehicle moving azimuth in step S720 in the flow chart illustrated in FIG. 13.

First, the reference azimuth determination unit 73 determines whether or not the speed of own-vehicle included in the running information on own-vehicle obtained in step S700 illustrated in FIG. 13 is higher than or equal to the predetermined threshold value x1 (step S722). When it is determined that the speed of own-vehicle is higher than or equal to the predetermined threshold value x1 (Yes in step S722), the reference azimuth determination unit 73 determines whether or not the amount of change in own-vehicle moving azimuth is greater than or equal to a predetermined threshold value x3 (step S724). The amount of change in own-vehicle moving azimuth is the absolute value of the difference between the own-vehicle moving azimuth a predetermined time ago and the own-vehicle moving azimuth at the present time. The predetermined threshold value x3 is a value which is used as a reference for determination based on the own-vehicle moving azimuth a predetermined time t1 ago as to whether or not own-vehicle has turned for preparation for making a right turn, and the predetermined threshold value x3 is set to approximately 45°, for example. The predetermined time t1 is an average time which is taken until a right turn is completed when it is made, and is set to approximately 20 seconds, for example. When it is determined that the amount of change in own-vehicle moving azimuth is greater than or equal to the predetermined threshold value x3 (Yes in step S724), it is highly probable that own-vehicle has completed the right turn, and thus the reference azimuth determination unit 73 determines the reference azimuth to be the own-vehicle moving azimuth at the present time (step S726). When it is determined that the amount of change in own-vehicle moving azimuth is less than the predetermined threshold value x3 (No in step S724), it is highly probable that own-vehicle has not completed the right turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained. On the other hand, when it is determined that the speed of own-vehicle is lower than the predetermined threshold value x1 (No in step S722), it is highly probable that own-vehicle has not completed the right turn, and thus the reference azimuth determination unit 73 terminates the processing. Here again, when the reference azimuth determination unit 73 terminates the processing with this flow, the processing in one routine ends without updating the reference azimuth, and thus the reference azimuth determined or held in the previous routine is maintained.

Figure 15:
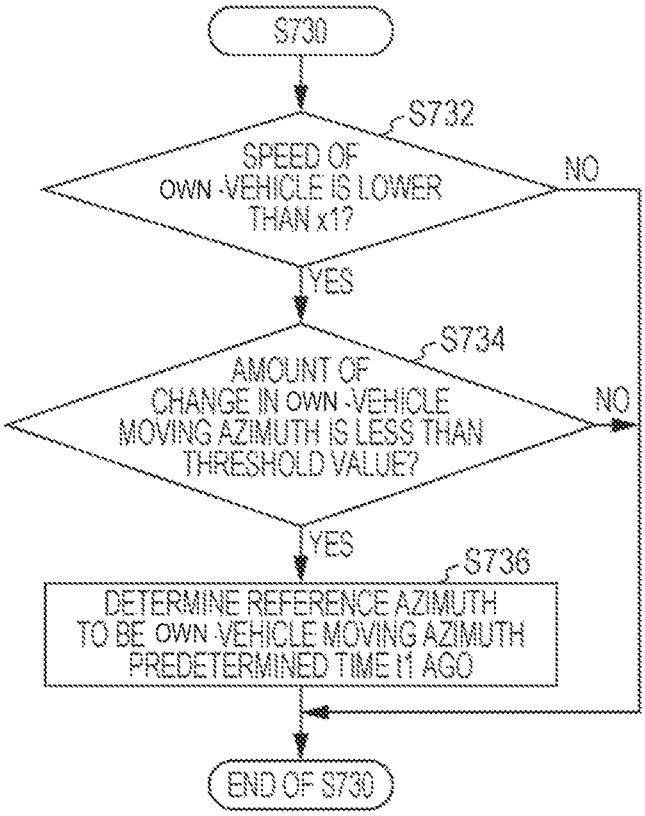
FIG. 15 is a flow chart illustrating an exemplary processing flow of determination made by the reference azimuth determination unit 73 as to whether or not the reference azimuth at the present time is held.

FIG. 15 is a flow chart illustrating an exemplary processing flow of determination made by the reference azimuth determination unit 73 as to whether or not the reference azimuth at the present time is held. The processing of the flow chart illustrated in FIG. 15 illustrates the detailed steps of the processing of determination as to whether or not the reference azimuth at the present time is held in step S730 in the flow chart illustrated in FIG. 13.

First, the reference azimuth determination unit 73 determines whether or not the speed of own-vehicle is lower than the predetermined threshold value x1 (step S732). When it is determined that the speed of own-vehicle is lower than the predetermined threshold value x1 (Yes in step S732), the reference azimuth determination unit 73 determines whether or not the amount of change in own-vehicle moving azimuth is less than the predetermined threshold value x3 (step S734). When it is determined that the amount of change in own-vehicle moving azimuth is less than the predetermined threshold value x3 (Yes in step S734), the reference azimuth determination unit 73 determines the reference azimuth to be the own-vehicle moving azimuth the predetermined time t1 ago (step S736). When it is determined that the amount of change in own-vehicle moving azimuth is not less than the predetermined threshold value x3 (No in step S734), it is highly probable that own-vehicle has completed the right turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained. On the other hand, when it is determined that the speed of own-vehicle is not lower than the predetermined threshold value x1 (No in step S732), it is highly probable that own-vehicle has completed the right turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained.

Figure 16:
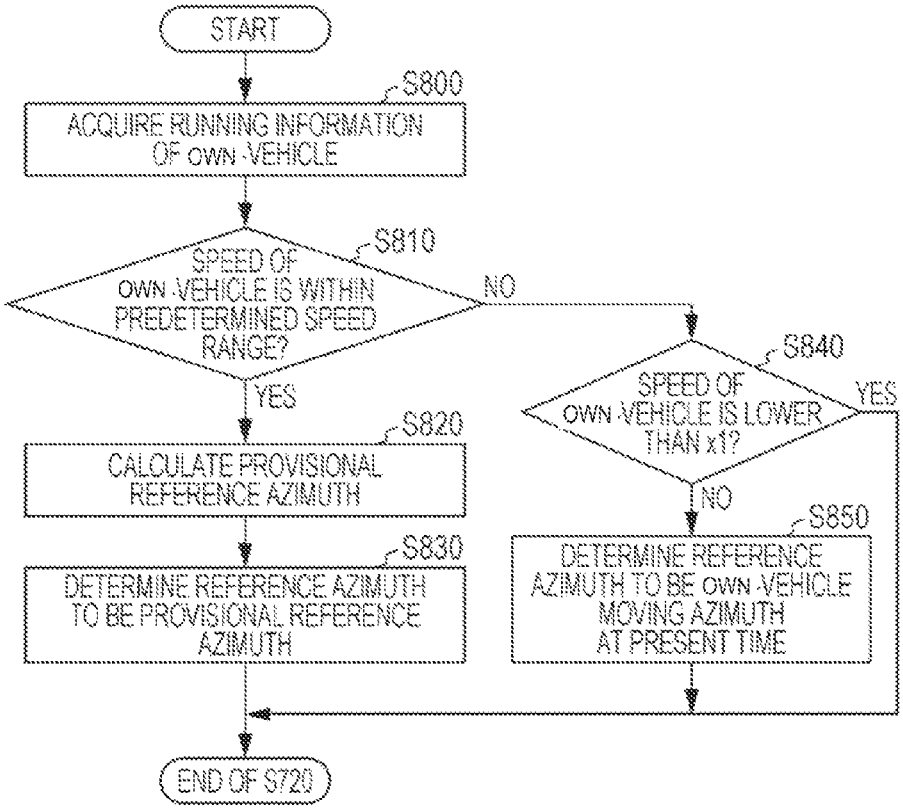
FIG. 16 is a flow chart illustrating a still another exemplary processing flow of determining a reference azimuth by the reference azimuth determination unit 73.

FIG. 16 is a flow chart illustrating a still another exemplary processing flow of determining a reference azimuth by the reference azimuth determination unit 73. First, as the running information on own-vehicle, the reference azimuth determination unit 73 obtains information indicating the position of own-vehicle, information indicating the speed of own-vehicle, and information indicating the acceleration of own-vehicle which have been acquired by the driving support control unit 70 (step S800). Next, the reference azimuth determination unit 73 determines whether or not the speed of own-vehicle included in the running information on own-vehicle is within the range of the predetermined threshold values x1 to x2 (step S810). Although it is assumed that the predetermined threshold value x1<the predetermined threshold value x2 herein, this relationship may be reversed. When it is determined that the speed of own-vehicle is within the range of the predetermined threshold values x1 to x2 (Yes in step S820), the reference azimuth determination unit 73 calculates a provisional reference azimuth. The provisional reference azimuth is a provisional moving azimuth which is calculated based on the position of own-vehicle the predetermined time t1 ago.

Figure 17:
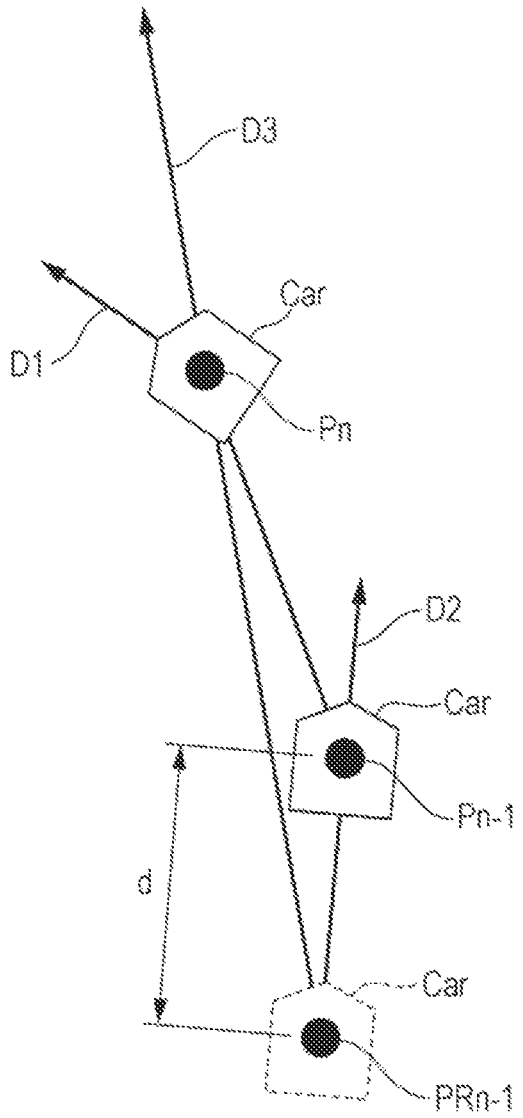
FIG. 17 illustrates an exemplary method of calculating a provisional reference azimuth.

Here, a method of calculating a provisional reference azimuth will be described in detail with reference to FIG. 17. FIG. 17 illustrates an exemplary method of calculating a provisional reference azimuth. A position Pn of the motor vehicle Car (own-vehicle) is the position of the motor vehicle Car at the present time. An azimuth D1 is the own-vehicle moving azimuth of the motor vehicle Car at the position Pn. A position Pn−1 of the motor vehicle Car is the position of the motor vehicle Car the predetermined time t1 ago. An azimuth D2 is the own-vehicle moving azimuth of the motor vehicle Car at the position Pn−1. A position PRn−1 of the motor vehicle Car is the position to which the motor vehicle Car is virtually moved from the position Pn−1 in the opposite direction to the azimuth D2 by a predetermined distance d [m]. The predetermined distance d [m] is set to approximately 5 [m], for example. Here, the reference azimuth determination unit 73 calculates an azimuth D3 which is the direction of the line segment starting from the position PRn−1 to the position Pn.

Returning to FIG. 16, the reference azimuth determination unit 73 then determines the reference azimuth to be the calculated provisional reference azimuth (step S830), and terminates the processing. On the other hand, when it is determined that the speed of own-vehicle is not within the range of the predetermined threshold values x1 to x2 (No in step S820), the reference azimuth determination unit 73 determines whether or not the speed of own-vehicle is lower than the predetermined threshold value x1 (step S840). When it is determined that the speed of own-vehicle is lower than the predetermined threshold value x1 (Yes in step S840), the reference azimuth determination unit 73 terminates the processing. On the other hand, when it is determined that the speed of own-vehicle is not lower than the predetermined threshold value x1 (No in step S840), the reference azimuth determination unit 73 determines the reference azimuth to be the own-vehicle moving azimuth at the present time (step S850) and terminates the processing.

In this manner, the driving support device 2 in the second embodiment performs predetermined safety control according to approach of another vehicle to the own-vehicle, the another vehicle being in an area which is defined based on a reference azimuth (which is centered on the area) as viewed from the own-vehicle on which the driving support device is mounted, and determines the reference azimuth to be one of the own-vehicle moving azimuth at the present time in the direction of the central axis of the own-vehicle and an azimuth which is different from the own-vehicle moving azimuth at the present time (for example, the own-vehicle moving azimuth when the turn signal starts to be operated, the own-vehicle moving azimuth a predetermined time ago, a provisional reference azimuth) based on information regarding the turn of own-vehicle, and thus the safety control may be performed at a more appropriate timing.

Also, the driving support device 2 determines the reference azimuth to be one of the own-vehicle moving azimuth at the present time in the direction of the central axis of the own-vehicle and an azimuth which is different from the own-vehicle moving azimuth at the present time (for example, the own-vehicle moving azimuth when the turn signal starts to be operated, the own-vehicle moving azimuth a predetermined time ago, a provisional reference azimuth) based on information regarding an operation state of the turn signal of own-vehicle, and thus it is possible to prevent safety control from being performed against the intention of a driver to turn own-vehicle.

Also, the driving support device 2 determines the reference azimuth to be one of the own-vehicle moving azimuth at the present time in the direction of the central axis of the own-vehicle and an azimuth which is different from the own-vehicle moving azimuth at the present time (for example, the own-vehicle moving azimuth when the turn signal starts to be operated, the own-vehicle moving azimuth a predetermined time ago, a provisional reference azimuth) based on the amount of change in own-vehicle moving azimuth within a predetermined time, and thus it is possible to prevent the reference direction from being fixed at an azimuth even after the right turn is made, the azimuth having an azimuth angle direction which is opposite to the direction of the turn of own-vehicle with respect to the own-vehicle moving azimuth at the present time.

In the above description, the reference azimuth determination unit 73 determines the reference azimuth to be one of the own-vehicle moving azimuth at the present time and an azimuth having an azimuth angle direction which is opposite to the direction of the turn of own-vehicle with respect to the own-vehicle moving azimuth at the present time (for example, the own-vehicle moving azimuth when the turn signal starts to be operated, the own-vehicle moving azimuth a predetermined time ago, a provisional reference azimuth). However, the reference azimuth determination unit 73 may determine the reference azimuth to be one of the own-vehicle moving azimuth at the present time and an azimuth having an azimuth angle direction which is different from the turn direction of own-vehicle and is rotated in the turn direction with respect to the own-vehicle moving azimuth.

Third Embodiment

Figure 18:
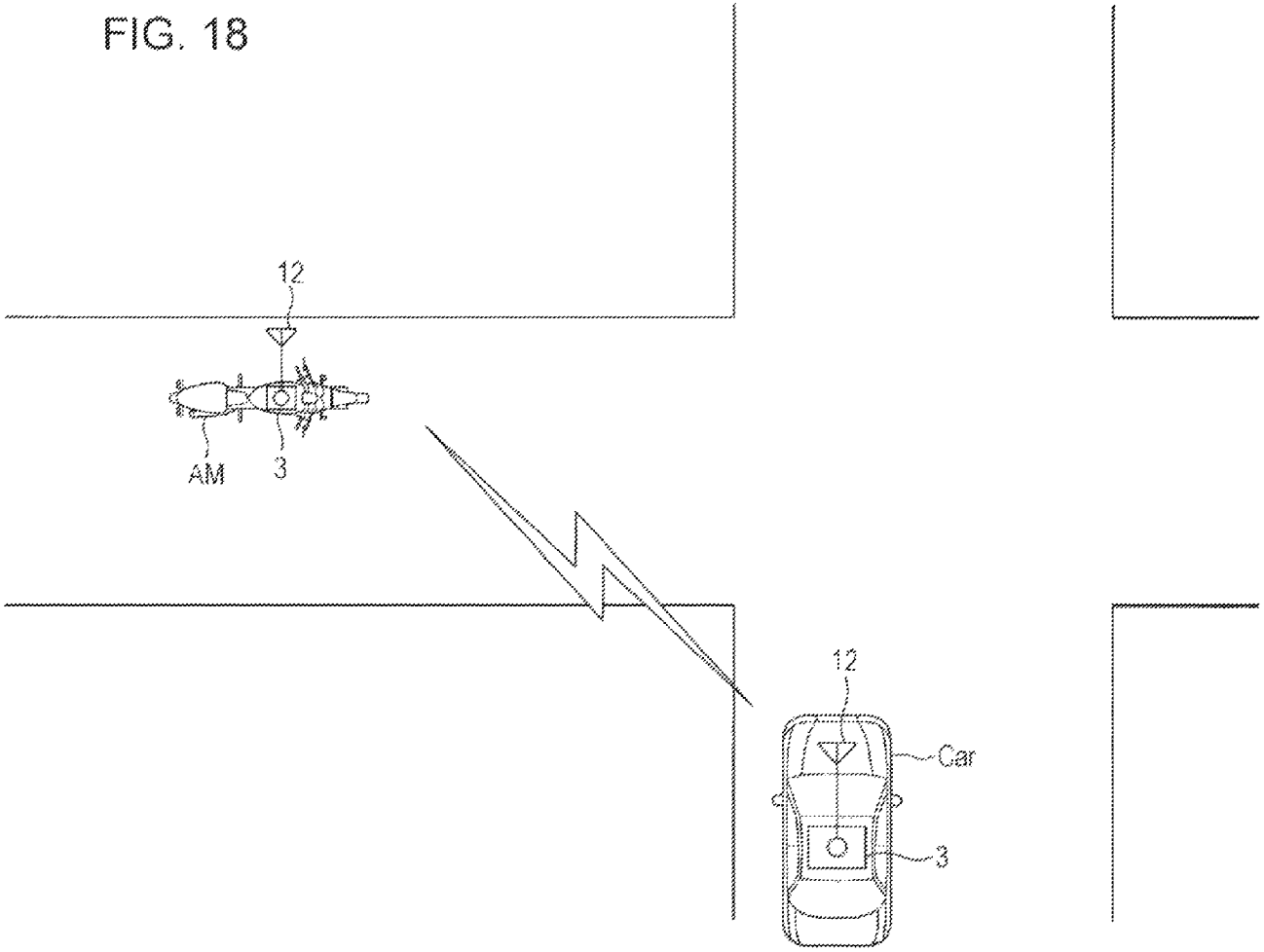
FIG. 18 illustrates an example of a situation in which communication is performed by a driving support device 3 according to a third embodiment.

Hereinafter, a third embodiment of the present disclosure will be described with reference to the accompanying drawings. FIG. 18 illustrates an example of a situation in which communication is performed between a driving support device 3 according to a third embodiment. In FIG. 18, a driving support device 3 is mounted on each of a four-wheel motor vehicle Car and a two-wheel motor vehicle AM, and vehicle-to-vehicle communication is performed via respective antennas 12. It is to be noted that the driving support device 3 is used in the manner in which communication may be performed between the driving support devices mounted on four-wheel motor vehicles or between the driving support devices mounted on two-wheel motor vehicles. Also, driving support devices 3 may perform communication indirectly between vehicles by utilizing road-to-vehicle communication via a relay device installed on the roadside. In the following, a description is given by assuming that the driving support devices 3 perform communication directly between vehicles. Such communication is performed in compliance with radio communication standard such as IEEE 802.11. However, without being limited to this, communication may be performed in compliance with dedicated communication standard.

Figure 19:
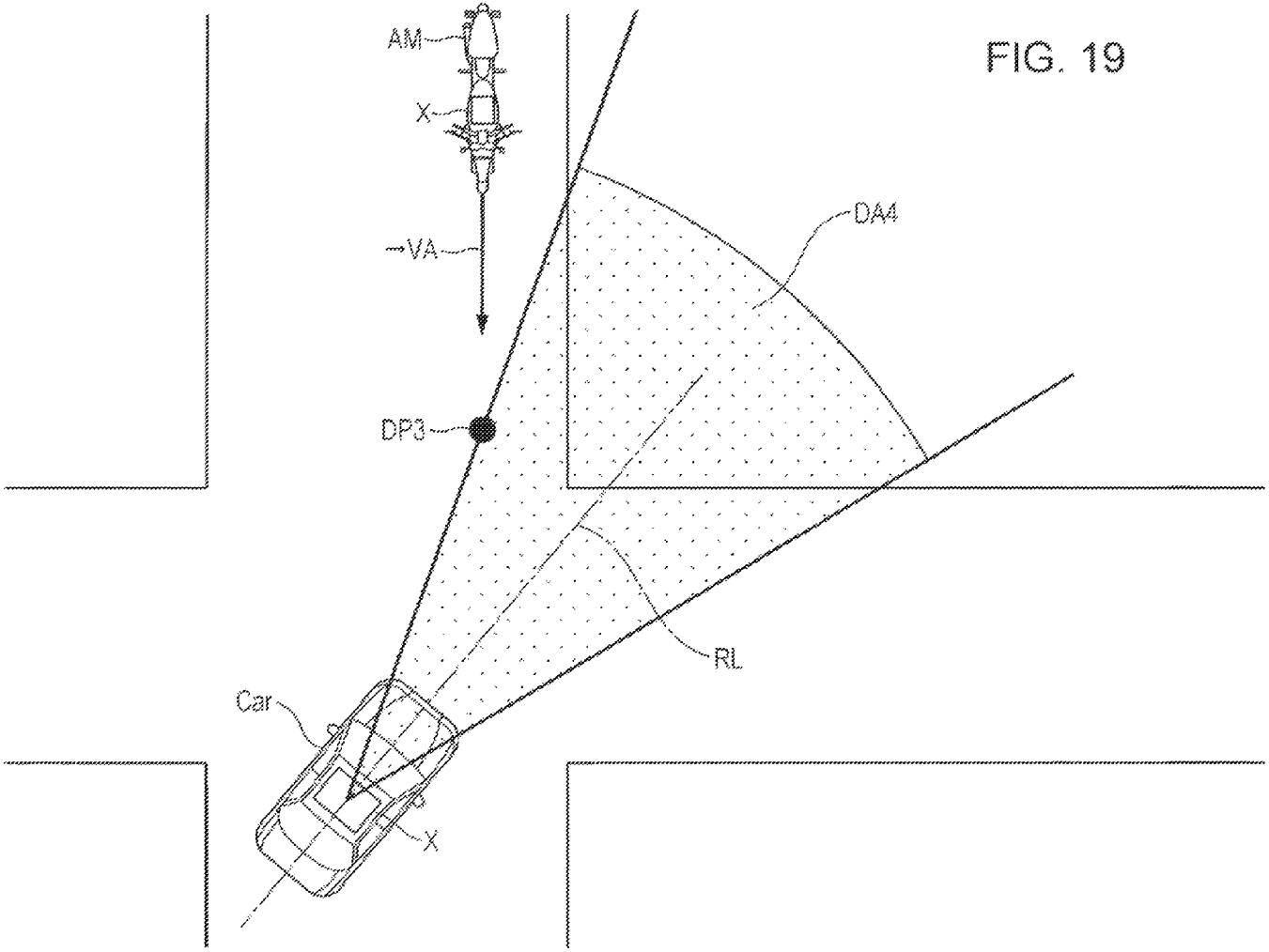
FIG. 19 illustrates an example of a situation in which another vehicle is detected by a conventional driving support device X in comparison to the case where the driving support device 3 according to the third embodiment is used.

FIG. 19 illustrates an example of a situation in which another vehicle is detected by a driving support device X in comparison to the case of the driving support device 3 according to the third embodiment. Hereinafter, based on the viewpoint of a driving support device X, own-vehicle refers to the vehicle on which the driving support device X is mounted and another vehicle refers to the vehicle on which another driving support device X is mounted. In FIG. 19, a motor vehicle Car (own-vehicle) intends to make a right turn at an intersection. The motor vehicle Car has slightly turned at a low speed and stopped to wait for an appropriate timing for making a right turn. The driving support device X mounted on the motor vehicle Car, when detecting another vehicle which moves into an area DA4, performs predetermined safety control based on the positional relationship between own-vehicle and the another vehicle. The predetermined safety control includes, for example, generating a warning sound, causing a braking device to operate, and causing a portion which is in constant contact with a driver to vibrate. Also, the area DA4 extends in the direction of a reference line RL which is defined as 0°, the direction being the own-vehicle moving azimuth immediately before the motor vehicle Car stops. The two-wheel motor vehicle AM (another vehicle) is moving in the direction indicated by a velocity vector →VA, and when arrived at a detection point DP3, predetermined safety control is performed by the driving support device X mounted on the motor vehicle Car.

Figure 20:
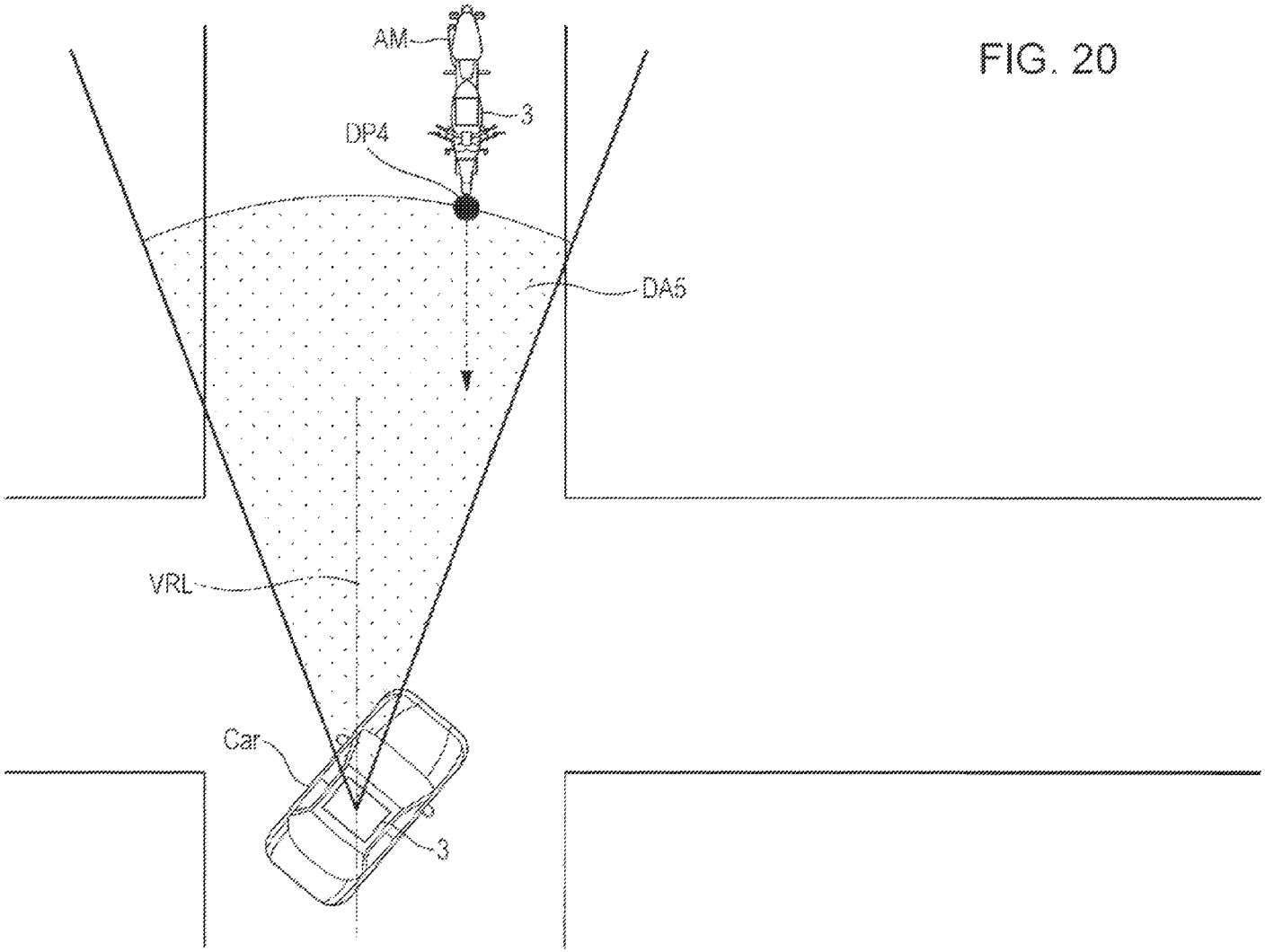
FIG. 20 illustrates an example of a situation in which another vehicle, which is approaching own-vehicle at an intersection, is detected by the driving support device 3 according to the third embodiment.

Here, the difference between the driving support device X as a comparative example illustrated in FIG. 19 and the driving support device 3 in the third embodiment will be described with reference to FIG. 20. FIG. 20 illustrates an example of a situation in which another vehicle, which is approaching own-vehicle at an intersection, is detected by the driving support device 3 according to the third embodiment. Hereinafter, based on the viewpoint of a driving support device 3, own-vehicle refers to the vehicle on which the driving support device 3 is mounted and another vehicle refers to the vehicle on which another driving support device 3 is mounted. In FIG. 20, similarly to FIG. 19, a motor vehicle Car intends to make a right turn at an intersection. The motor vehicle Car has slightly turned at a low speed and stopped to wait for an appropriate timing for making a right turn. The area DA5 is defined by the range of relative moving azimuth of another vehicle approaching own-vehicle from the front and the range of relative distance between own-vehicle and another vehicle. For example, the range of moving azimuth of another vehicle is approximately −10° to 10°, and the range of relative distance between own-vehicle and another vehicle is approximately 200 [m]. One of the differences between the situation illustrated in FIG. 19 and the situation illustrated in FIG. 20 is that the direction in which the area DA4 extends is different from the direction in which the area DA5 extends. The area DA5 extends in the direction in which the reference line VRL direction is defined as 0°. The direction of the reference line VRL is the azimuth that is determined to be the reference azimuth by the below-described reference azimuth determination unit 73. The two-wheel motor vehicle AM, when reaching a detection point DP4, is detected by the driving support device 3 mounted on the motor vehicle Car, and predetermined safety control is performed.

When the example of FIG. 19 is compared with the example of FIG. 20, the detection area of the driving support device 3 illustrated in FIG. 20 is the area (the area along the road on which the two-wheel motor vehicle AM moves) to which more attention should be naturally given. For this reason, when the detection point DP4 in FIG. 20 is compared with the detection point DP3 in FIG. 19, the detection point DP4 is more distant away from the motor vehicle Car than the detection point DP3 is. Consequently, the driving support device 3 may detect approach of another vehicle at a point more distant away than the driving support device X as a comparative example does, and may perform predetermined safety control for another vehicle at an earlier timing.

Figure 21:
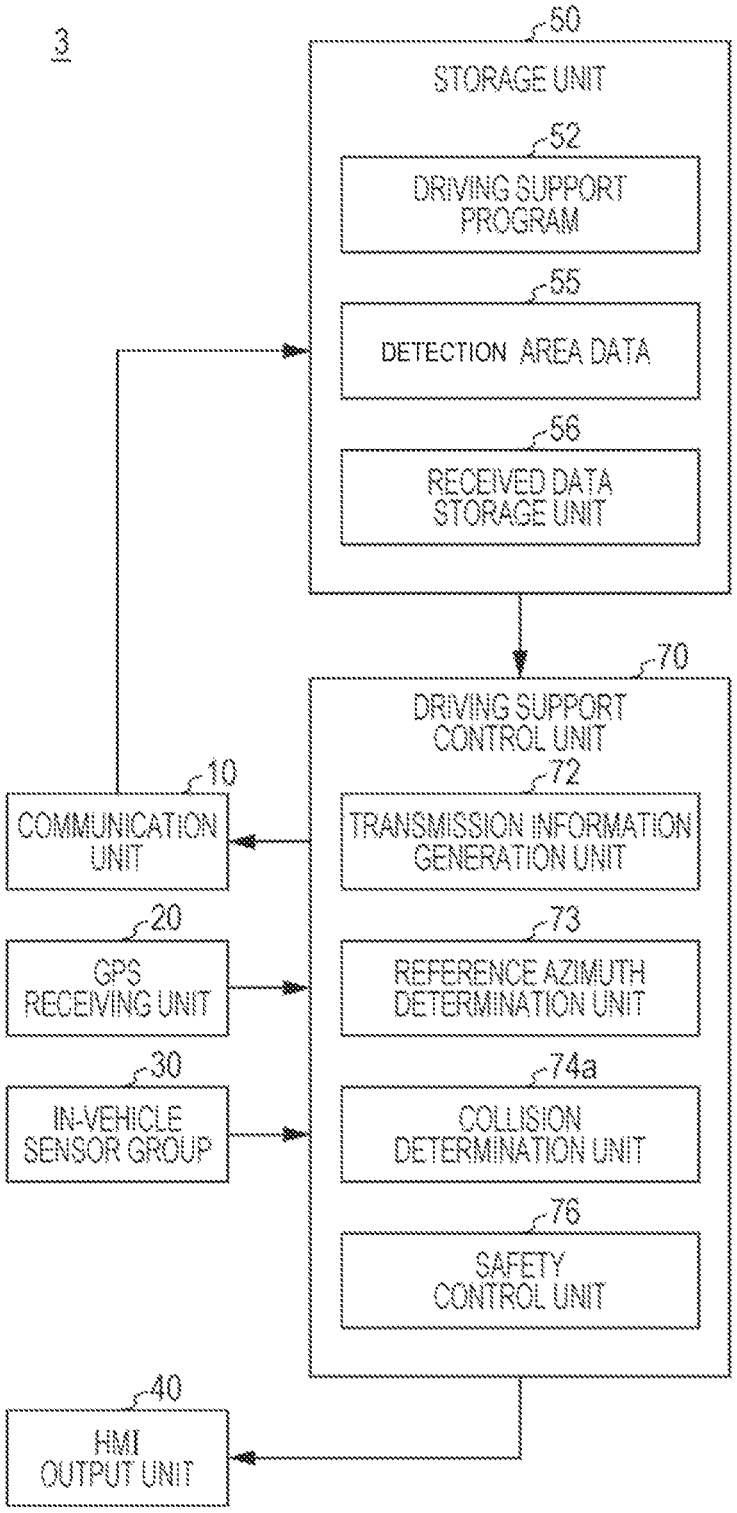
FIG. 21 is a diagram illustrating an exemplary configuration of the driving support device 3 according to the third embodiment.

FIG. 21 is a diagram illustrating an exemplary configuration of the driving support device 3. The driving support device 3 includes, for example, the communication unit 10, the GPS receiving unit 20, the in-vehicle sensor group 30, the HMI output unit 40, the storage unit 50, and the driving support control unit 70. The communication unit 10 includes, for example, the antenna 12, a modulation unit, a demodulation unit, and an up/down converter, and performs communication. The communication unit 10 allows bidirectional communication via radio communication with another driving support device mounted on another vehicle, and transmits/receives radio waves via the antenna 12, the radio waves being in a predetermined RF band which is used for radio communication. The communication unit 10 receives running information on another vehicle from the driving support device 3 mounted on another vehicle, and causes the received data storage unit 56 of the storage unit 50 to store the received running information. The running information on another vehicle includes, for example, the information indicating the speed, position, and moving azimuth of the another vehicle. Hereinafter, based on the viewpoint of a driving support device 3, own-vehicle refers to the vehicle on which the driving support device 3 is mounted and another vehicle refers to the vehicle on which another driving support device 3 is mounted. In addition, the communication unit 10 transmits the running information on own-vehicle to the driving support device 3 mounted in another vehicle, the running information being generated by the transmission information generation unit 72 of the driving support control unit 70. The running information on own-vehicle includes, for example, information indicating the speed, information indicating the position, and information indicating the moving azimuth of the own-vehicle.

The GPS receiving unit 20 calculates the position (latitude, longitude, and altitude) of own-vehicle based on a navigation message which is obtained by demodulating the signals received by a GPS antenna 22 from the GPS Satellite. The GPS receiving unit 20 transmits the calculated position of the own-vehicle to a CAN bus via, for example, a navigation ECU which is not illustrated.

The in-vehicle sensor group 30 includes, for example, a vehicle speed sensor to detect a speed of own-vehicle, an acceleration sensor to detect an acceleration, a steering angle sensor to detect a steering angle (which may be any one of the steering angle and the steer angle of a wheel), and a blinker switch to detect a direction of operation of the turn signals (blinkers). The various sensors included in the in-vehicle sensor group 30 each transmit the detected value or state to the CAN bus directly or via the ECU. The HMI output unit 40 includes, for example, a speaker, a buzzer, a display device, and a vibrator.

The storage unit 50 includes, for example, a RAM, a register, a HDD, and a SSD. The storage unit 50 stores various programs as driving support program 52, which are to be executed by a CPU (not illustrated) of the driving support device 3. In addition, the storage unit 50 stores detection area data 55 which is utilized by the below-described driving support control unit 70 for various types of determination. Furthermore, the storage unit 50 includes the received data storage unit 56 that temporarily stores data which has been received by the communication unit 10. It is to be noted that the data 54 for collision determination may be pre-registered or may be set later by a user.

Here, the detection area data 55 will be described with reference to FIG. 22. FIG. 22 is a table illustrating an example of the detection area data 55 stored in storage unit 50. As illustrated, the detection area data 55 includes the range of relative moving azimuth of another vehicle and the relative distance range of another vehicle in a detection area. The range of relative moving azimuth of another vehicle indicates the angle range of a detection area for which the reference azimuth determined by the reference azimuth determination unit 73 is defined as 0°. The detection area data 55 is not necessarily stored in the storage unit 50 with the data structure as illustrated in FIG. 22, and may be, for example, pre-registered in the reference azimuth determination unit 73, or various numerical values included in the detection area data 55 may be derived based on functions, running information on another vehicle, and running information on own-vehicle which are registered in the reference azimuth determination unit 73.

Returning to FIG. 21, the driving support control unit 70 includes, for example, the transmission information generation unit 72, the reference azimuth determination unit 73, a collision determination unit 74*a*, and the safety control unit 76. Part or all of these functional units are achieved, for example, by the CPU (not illustrated) executing the driving support program 52 stored in the storage unit 50. It is to be noted that part or all of these functional units may be a hardware functional unit such as an LSI or an ASIC. The driving support control unit 70 obtains information indicating the position of own-vehicle from the GPS receiving unit 20 and obtains information indicating the speed of own-vehicle and information indicating the acceleration of own-vehicle from the in-vehicle sensor group 30. The transmission information generation unit 72 generates running information on own-vehicle including the moving azimuth, position, and speed of own-vehicle, based on the position and acceleration obtained from the GPS receiving unit 20 and the in-vehicle sensor group 30, and controls the communication unit 10 so that the generated running information on own-vehicle is transmitted to another vehicle.

The reference azimuth determination unit 73 determines whether or not running of own-vehicle is substantially turning at a low speed, based on the running information on own-vehicle. When it is determined that the running of own-vehicle is not substantially turning at a low speed, the reference azimuth determination unit 73 determines the reference azimuth to be the own-vehicle moving azimuth. When it is determined that the running of own-vehicle is substantially turning at a low speed, the reference azimuth determination unit 73 determines the reference azimuth to be an azimuth having an azimuth angle direction which is opposite to the direction of the turn of own-vehicle with respect to the own-vehicle moving azimuth. The reference azimuth determination unit 73 then outputs the determined reference azimuth to the collision determination unit 74*a*.

The collision determination unit 74*a* acquires the running information on another vehicle which is obtained from the received data storage unit 56, information indicating the position of own-vehicle and information indicating the speed and acceleration of own-vehicle (running information on own-vehicle) which are obtained from the GPS receiving unit 20 and the in-vehicle sensor group 30, and the reference azimuth which is obtained from the reference azimuth determination unit 73. The collision determination unit 74*a* reads the detection area data 55 from the storage unit 50. The collision determination unit 74*a* then defines an area for detecting another vehicle based on the obtained reference azimuth and detection area data 55, and determines whether or not it is probable that another vehicle collides with own-vehicle based on the defined area, the running information on the obtained another vehicle, and the running information on own-vehicle obtained from the transmission information generation unit 72. When it is determined that another vehicle probably collide with own-vehicle, the collision determination unit 74*a* outputs a result of the determination to the safety control unit 76.

The safety control unit 76 performs predetermined safety control based on the result of the determination obtained from the collision determination unit 74*a*. The predetermined safety control includes, for example, generating a warning sound, causing a braking device to operate, and causing a portion which is in constant contact with a driver to vibrate. In the following description, it is assumed that the safety control unit 76 causes the HMI output unit 40 to generate a warning sound as predetermined safety control, the warning sound warning a own-vehicle's driver of approach of another vehicle to own-vehicle.

Figure 23:
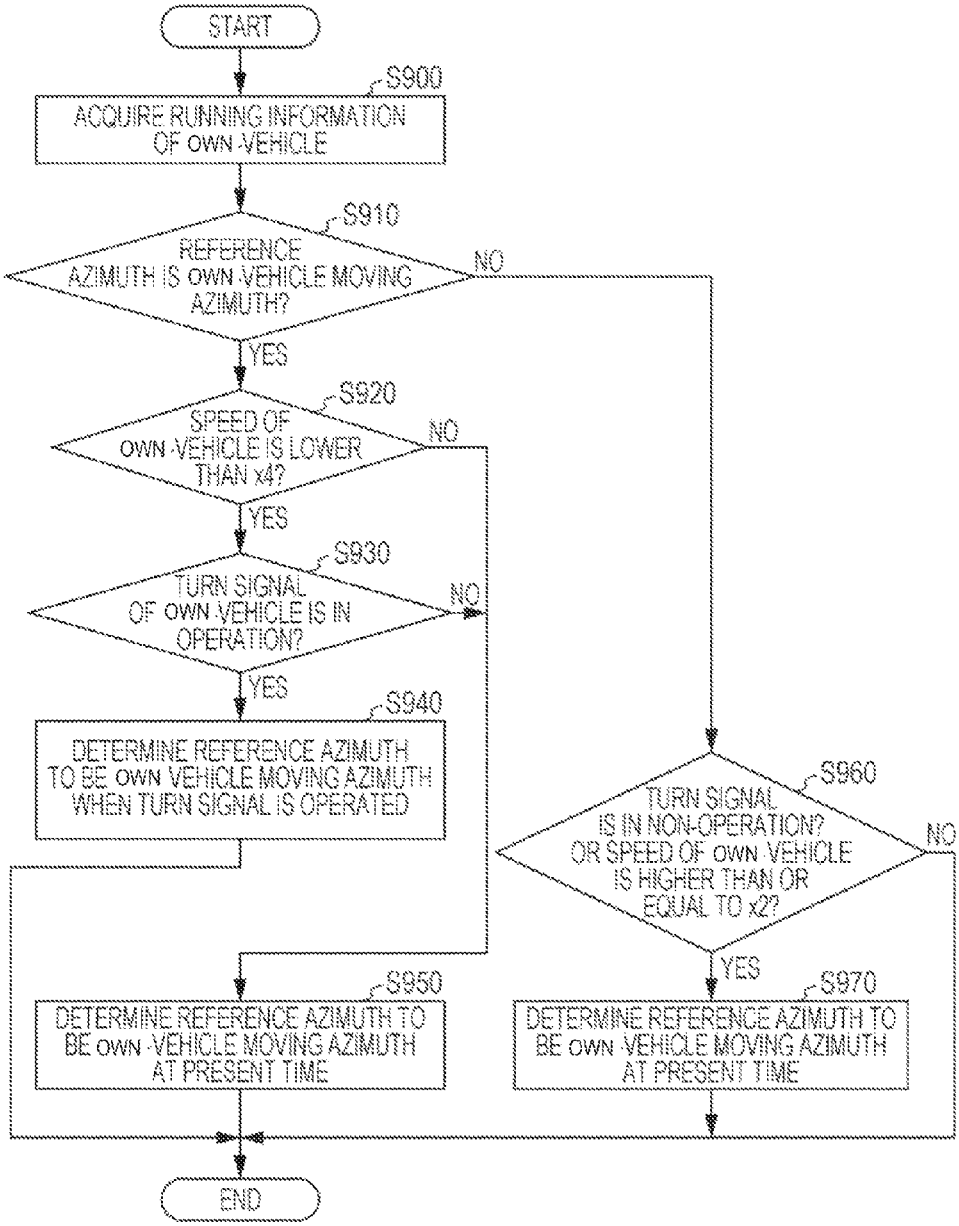
FIG. 23 is a flow chart illustrating an exemplary processing flow of determining a reference azimuth by the reference azimuth determination unit 73.

FIG. 23 is a flow chart illustrating an exemplary processing flow of determining a reference azimuth by the reference azimuth determination unit 73. First, the reference azimuth determination unit 73 obtains information indicating the position of own-vehicle, information indicating the speed of own-vehicle, and information indicating the acceleration of own-vehicle (running information on own-vehicle) from the GPS receiving unit 20 and the in-vehicle sensor group 30 (step S900). Next, the reference azimuth determination unit 73 determines whether or not the reference azimuth determined or held in the last routine is own-vehicle moving azimuth (step S910). When it is determined that the reference azimuth is own-vehicle moving azimuth (Yes in step S910), the reference azimuth determination unit 73 determines whether or not the speed of own-vehicle is lower than a predetermined threshold value x4 (step S920). The predetermined threshold value x4 is a threshold value which is used as a reference for determining whether or not own-vehicle is running at a low speed, and the threshold value is set to approximately 5 [km] per hour, for example. When it is determined that the speed of own-vehicle is not lower than the predetermined threshold value x4 (No in step S920), the reference azimuth determination unit 73 determines the reference azimuth to be the own-vehicle moving azimuth at the present time (step S950), and subsequently terminates the processing. When it is determined that the speed of own-vehicle is lower than the predetermined threshold value x4 (Yes in step S920), the reference azimuth determination unit 73 determines whether or not the turn signal of own-vehicle is in operation (step S930). When it is determined that the turn signal of own-vehicle is in operation (Yes in step S930), the reference azimuth determination unit 73 determines the reference azimuth to be the own-vehicle moving azimuth at the time when the turn signal starts to be operated (step S940), and terminates the processing. Here, "the own-vehicle moving azimuth at the time when the turn signal starts to be operated" is an example of "azimuth having an azimuth angle direction which is opposite to the direction of the turn of own-vehicle with respect to the own-vehicle moving azimuth". For this kind of "azimuth", the below-described "own-vehicle moving azimuth a predetermined time ago", "provisional reference azimuth", or "extending direction of road" may be used in addition to "the own-vehicle moving azimuth at the time when the turn signal starts to be operated". When it is determined that the turn signal of own-vehicle is not in operation (No in step S930), the flow proceeds to step S950 and the reference azimuth determination unit 73 determines the reference azimuth to be the own-vehicle moving azimuth at the present time.

On the other hand, when it is determined that the reference azimuth is not the own-vehicle moving azimuth in step S910 (No in step S910), the reference azimuth determination unit 73 determines whether or not the turn signal is not in operation, or the speed of own-vehicle is higher than or equal to a predetermined threshold value x5 (step S960). The predetermined threshold value x5 is a threshold value which is used as a reference for determining whether or not own-vehicle is running at a low speed, and the threshold value is set to approximately 5 [km] per hour, for example.

The predetermined threshold value x5 may be the same value as or a different value from the predetermined threshold value x4. When it is determined that the turn signal is not in operation, or the speed of own-vehicle is higher than or equal to the predetermined threshold value x5 (Yes in step S960), it is highly probable that own-vehicle is no longer running with a low speed turn, and thus the reference azimuth determination unit 73 determines the reference azimuth to be the own-vehicle moving azimuth at the present time (step S970), and terminates the processing. On the other hand, when it is determined that the turn signal is in operation, or the speed of own-vehicle is lower than the predetermined threshold value x5 (No in step S960), it is highly probable that own-vehicle is still running with a low speed turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained.

Figure 24:
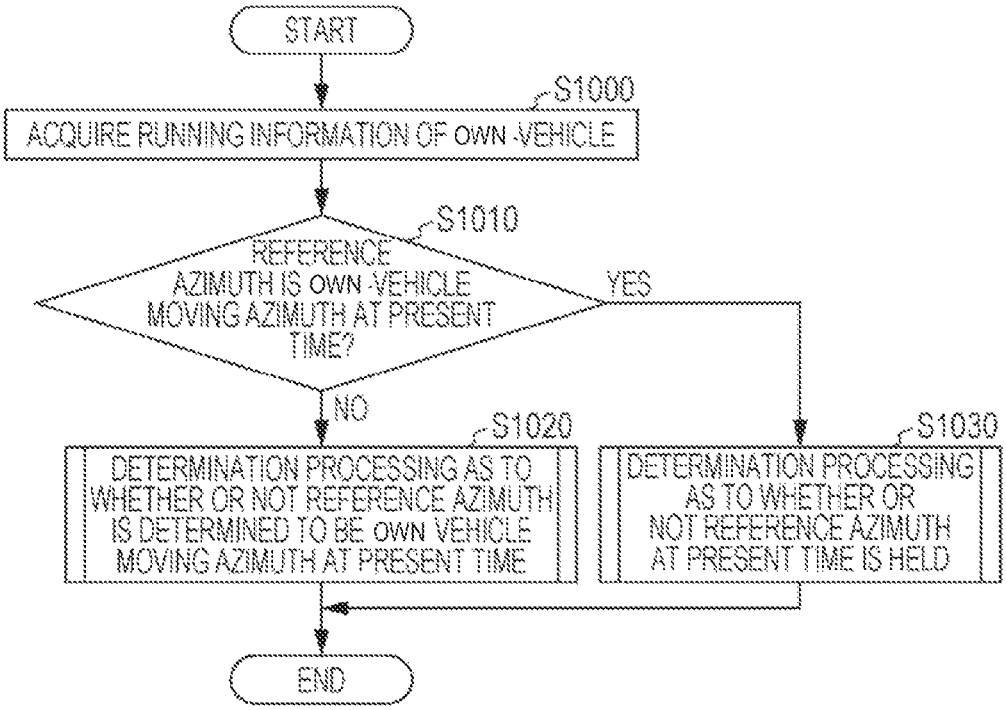
FIG. 24 is a flow chart illustrating another exemplary processing flow of determining a reference azimuth by the reference azimuth determination unit 73.

FIG. 24 is a flow chart illustrating another exemplary processing flow of determining a reference azimuth by the reference azimuth determination unit 73. First, as the running information on own-vehicle, the reference azimuth determination unit 73 obtains information indicating the position of own-vehicle, information indicating the speed of own-vehicle, and information indicating the acceleration of own-vehicle which have been acquired by the driving support control unit 70 (step S1000). Next, the reference azimuth determination unit 73 determines whether or not the reference azimuth determined immediately before (at the time of the last processing) is the own-vehicle moving azimuth at the present time (step S1010). When it is determined that the reference azimuth is the own-vehicle moving azimuth at the present time (Yes in step S1010), the reference azimuth determination unit 73 performs processing of determination as to whether or not the reference azimuth at the present time is held (step S1030), and terminates the processing. On the other hand, when it is determined that the reference azimuth is not the own-vehicle moving azimuth at the present time (No in step S1010), the reference azimuth determination unit 73 performs processing of determination (step S1020) as to whether or not the reference azimuth is determined to be the own-vehicle moving azimuth at the present time, and terminates the processing. The details of the determination as to whether or not the reference azimuth is determined to be the own-vehicle moving azimuth at the present time will be described later.

Figure 25:
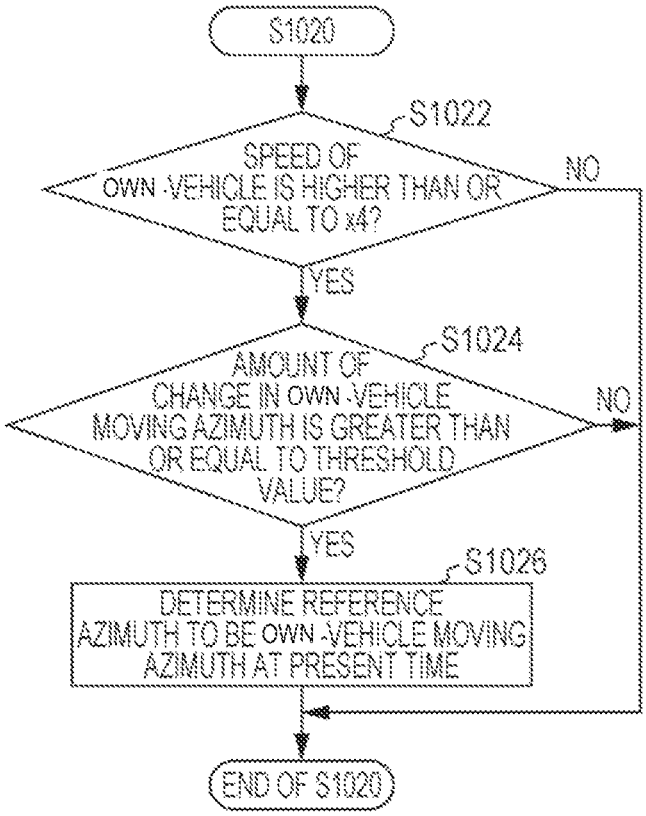
FIG. 25 is a flow chart illustrating an exemplary processing flow of determination made by the reference azimuth determination unit 73 as to whether or not the reference azimuth is determined to be the own-vehicle moving azimuth.

FIG. 25 is a flow chart illustrating an exemplary processing flow of determination made by the reference azimuth determination unit 73 as to whether or not the reference azimuth is determined to be the own-vehicle moving azimuth. The processing of the flow chart illustrated in FIG. 25 illustrates the detailed steps of the processing of determination as to whether or not the reference azimuth is determined to be the own-vehicle moving azimuth in step S1020 in the flow chart illustrated in FIG. 24.

First, the reference azimuth determination unit 73 determines whether or not the speed of own-vehicle included in the running information on own-vehicle obtained in step S1000 illustrated in FIG. 24 is higher than or equal to the predetermined threshold value x4 (step S1022). When it is determined that the speed of own-vehicle is higher than or equal to the predetermined threshold value x4 (Yes in step S1022), the reference azimuth determination unit 73 determines whether or not the amount of change in own-vehicle moving azimuth is greater than or equal to a predetermined threshold value x6 (step S1024). The amount of change in own-vehicle moving azimuth is the absolute value of the difference between the own-vehicle moving azimuth a predetermined time ago and the own-vehicle moving azimuth at the present time. The predetermined threshold value x6 is a value which is used as a reference for determination based on the own-vehicle moving azimuth a predetermined time t2 ago as to whether or not own-vehicle has turned for preparation for making a right turn, and the predetermined threshold value x6 is set to approximately 45°, for example. The predetermined time t2 is an average time which is taken until a right turn is completed when it is made, and is set to approximately 20 seconds, for example. When it is determined that the amount of change in own-vehicle moving azimuth is greater than or equal to the predetermined threshold value x6 (Yes in step S1024), it is highly probable that own-vehicle has completed the right turn, and thus the reference azimuth determination unit 73 determines the reference azimuth to be the own-vehicle moving azimuth at the present time (step S1026). When it is determined that the amount of change in own-vehicle moving azimuth is less than the predetermined threshold value x6 (No in step S1024), it is highly probable that own-vehicle has not completed the right turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained. On the other hand, when it is determined that the speed of own-vehicle is lower than the predetermined threshold value x4 (No in step S1022), it is highly probable that own-vehicle has not completed the right turn, and thus the reference azimuth determination unit 73 terminates the processing. Here again, when the reference azimuth determination unit 73 terminates the processing with this flow, the processing in one routine ends without updating the reference azimuth, and thus the reference azimuth determined or held in the previous routine is maintained.

Figure 26:
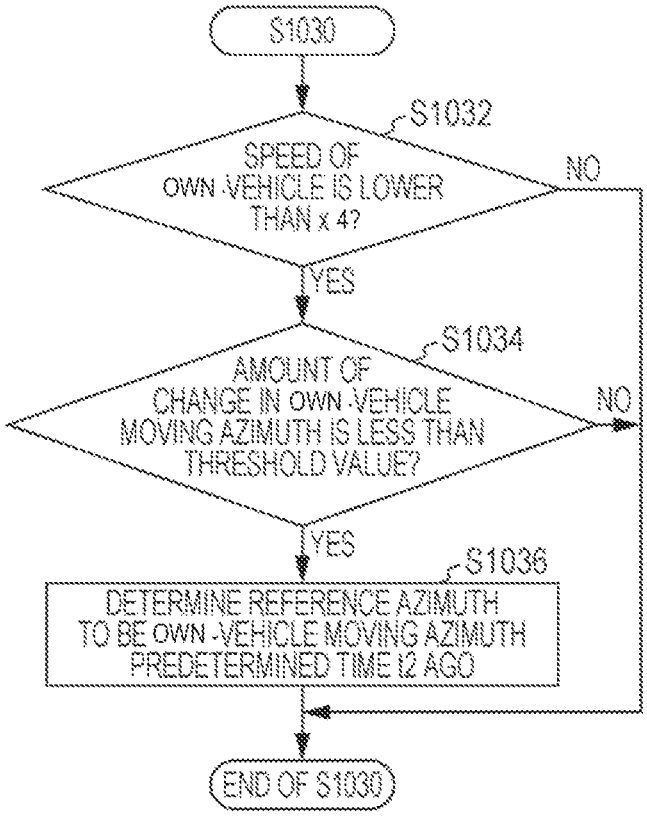
FIG. 26 is a flow chart illustrating an exemplary processing flow of determination made by the reference azimuth determination unit 73 as to whether or not the reference azimuth at the present time is held.

FIG. 26 is a flow chart illustrating an exemplary processing flow of determination made by the reference azimuth determination unit 73 as to whether or not the reference azimuth at the present time is held. The processing of the flow chart illustrated in FIG. 26 illustrates the detailed steps of the processing of determination as to whether or not the reference azimuth at the present time is held in step S1030 in the flow chart illustrated in FIG. 24.

First, the reference azimuth determination unit 73 determines whether or not the speed of own-vehicle is lower than the predetermined threshold value x4 (step S1032). When it is determined that the speed of own-vehicle is lower than the predetermined threshold value x4 (Yes in step S1022), the reference azimuth determination unit 73 determines whether or not the amount of change in own-vehicle moving azimuth is less than the predetermined threshold value x6 (step S1034). When it is determined that the amount of change in own-vehicle moving azimuth is less than the predetermined threshold value x6 (Yes in step S1034), the reference azimuth determination unit 73 determines the reference azimuth to be the own-vehicle moving azimuth the predetermined time t2 ago (step S1036). When it is determined that the amount of change in own-vehicle moving azimuth is not less than the predetermined threshold value x6 (No in step S1034), it is highly probable that own-vehicle has completed the right turn, and thus the reference azimuth determination unit 73 terminates the processing. Here, when the reference azimuth determination unit 73 terminates the processing with this flow, the processing in one routine ends without updating the reference azimuth, and thus the reference azimuth determined or held in the previous routine is maintained. On the other hand, when it is determined that the speed of own-vehicle is not lower than the predetermined threshold value x4 (No in step S1032), it is highly probable that own-vehicle has completed the right turn, and thus the reference azimuth determination unit 73 terminates the processing. Here again, when the reference azimuth determination unit 73 terminates the processing with this flow, the processing in one routine ends without updating the reference azimuth, and thus the reference azimuth determined or held in the previous routine is maintained.

Figure 27:
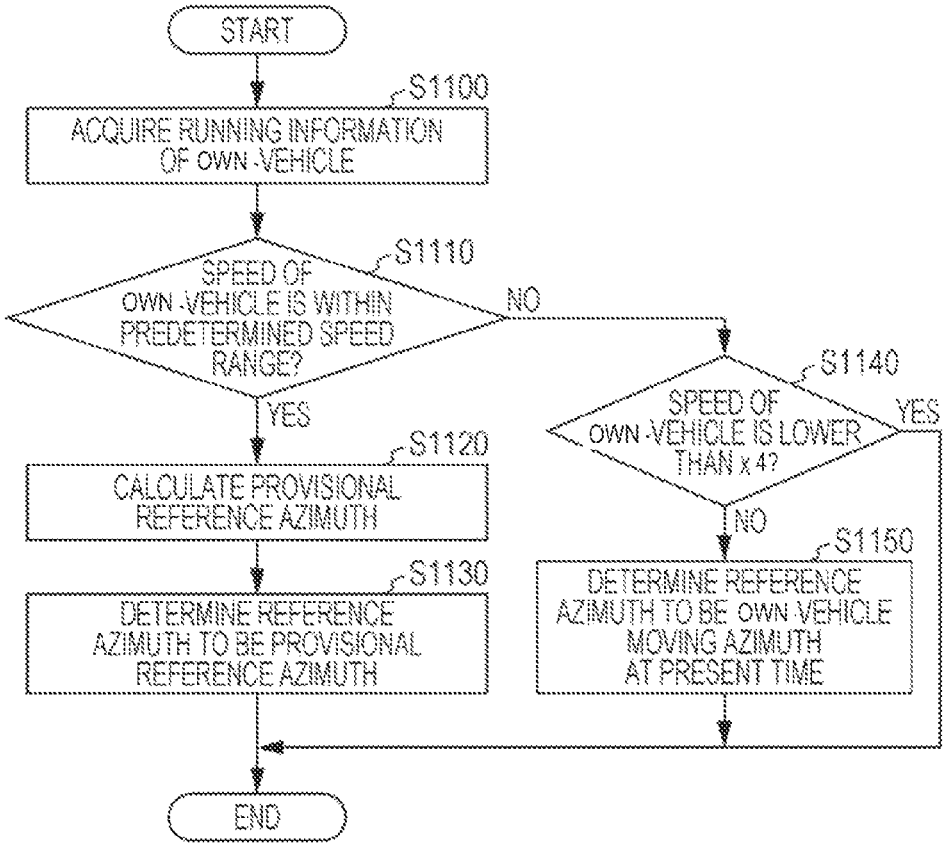
FIG. 27 is a flow chart illustrating still another exemplary processing flow of determining a reference azimuth by the reference azimuth determination unit 73.

FIG. 27 is a flow chart illustrating still another exemplary processing flow of determining a reference azimuth by the reference azimuth determination unit 73. First, as the running information on own-vehicle, the reference azimuth determination unit 73 obtains information indicating the position of own-vehicle, information indicating the speed of own-vehicle, and information indicating the acceleration of own-vehicle which have been acquired by the driving support control unit 70 (step S1100). Next, the reference azimuth determination unit 73 determines whether or not the speed of own-vehicle included in the running information on own-vehicle is within the range of the predetermined threshold values x4 to x5 (step S1110). Although it is assumed that the predetermined threshold value x4<the predetermined threshold value x5 herein, this relationship may be reversed. When it is determined that the speed of own-vehicle is within the range of the predetermined threshold values x4 to x5 (Yes in step S1120), the reference azimuth determination unit 73 calculates a provisional reference azimuth. The provisional reference azimuth is a provisional moving azimuth which is calculated based on the position of own-vehicle the predetermined time t2 ago.

Figure 28:
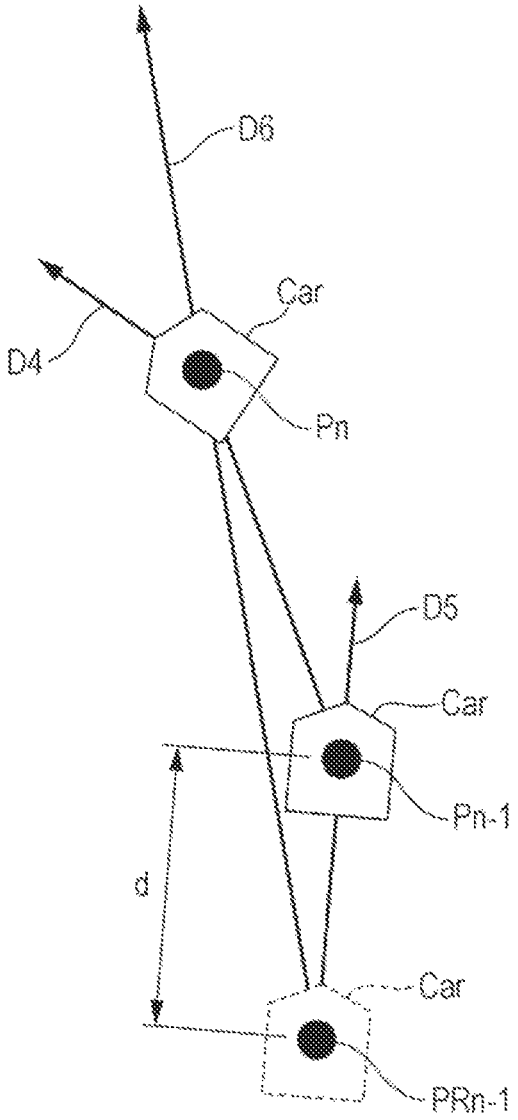
FIG. 28 illustrates an exemplary method of calculating a provisional reference azimuth.

Here, a method of calculating a provisional reference azimuth will be described in detail with reference to FIG. 28. FIG. 28 illustrates an exemplary method of calculating a provisional reference azimuth. A position Pn of the motor vehicle Car (own-vehicle) is the position of the motor vehicle Car at the present time. An azimuth D4 is the own-vehicle moving azimuth of the motor vehicle Car at the position Pn. A position Pn−1 of the motor vehicle Car is the position of the motor vehicle Car the predetermined time t2 ago. An azimuth D5 is the own-vehicle moving azimuth of the motor vehicle Car at the position Pn−1. A position PRn−1 of the motor vehicle Car is the position to which the motor vehicle Car is virtually moved from the position Pn−1 in the opposite direction to the azimuth D5 by a predetermined distance d [m]. The predetermined distance d [m] is set to approximately 5 [m], for example. Here, the reference azimuth determination unit 73 calculates an azimuth D6 which is the direction of the line segment starting from the position PRn−1 to the position Pn.

Returning to FIG. 27, the reference azimuth determination unit 73 then determines the reference azimuth to be the calculated provisional reference azimuth (step S1130), and terminates the processing. On the other hand, when it is determined that the speed of own-vehicle is not within the range of the predetermined threshold values x4 to x5 (No in step S1120), the reference azimuth determination unit 73 determines whether or not the speed of own-vehicle is lower than the predetermined threshold value x4 (step S1140). When it is determined that the speed of own-vehicle is lower than the predetermined threshold value x4 (Yes in step S1140), the reference azimuth determination unit 73 terminates the processing. On the other hand, when it is determined that the speed of own-vehicle is not lower than the predetermined threshold value x4 (No in step S1140), the reference azimuth determination unit 73 determines the reference azimuth to be the own-vehicle moving azimuth at the present time (step S1150) and terminates the processing.

In this manner, the driving support device 3 in the third embodiment performs predetermined safety control according to approach of another vehicle to the own-vehicle, the another vehicle being in an area which is defined centered on a reference azimuth as viewed from the own-vehicle on which the driving support device is mounted, and determines the reference azimuth to be one of the own-vehicle moving azimuth at the present time in the direction of the central axis of the own-vehicle and an azimuth which is different from the own-vehicle moving azimuth at the present time (for example, the own-vehicle moving azimuth when the turn signal starts to be operated, the own-vehicle moving azimuth a predetermined time ago, a provisional reference azimuth) based on information regarding the turn of own-vehicle, and thus the safety control may be performed at a more appropriate timing.

Also, the driving support device 3 determines the reference azimuth to be one of the own-vehicle moving azimuth at the present time in the direction of the central axis of the own-vehicle and an azimuth which is different from the own-vehicle moving azimuth at the present time (for example, the own-vehicle moving azimuth when the turn signal starts to be operated, the own-vehicle moving azimuth a predetermined time ago, a provisional reference azimuth) based on information regarding an operation state of the turn signal of own-vehicle, and thus it is possible to prevent safety control from being performed against the intention of a driver to turn own-vehicle.

Also, the driving support device 3 determines the reference azimuth to be one of the own-vehicle moving azimuth at the present time in the direction of the central axis of the own-vehicle and an azimuth having an azimuth angle direction which is opposite to the direction of the turn of own-vehicle with respect to the own-vehicle moving azimuth at the present time (for example, the own-vehicle moving azimuth when the turn signal starts to be operated, the own-vehicle moving azimuth a predetermined time ago, a provisional reference azimuth) based on the amount of change in own-vehicle moving azimuth within a predetermined time, and thus it is possible to prevent the reference direction from being fixed at an azimuth even after the right turn is made, the azimuth having an azimuth angle direction which is opposite to the direction of the turn of own-vehicle with respect to the own-vehicle moving azimuth at the present time.

In the above description, the reference azimuth determination unit 73 determines the reference azimuth to be one of the own-vehicle moving azimuth at the present time and an azimuth having an azimuth angle direction which is opposite to the direction of the turn of own-vehicle with respect to the own-vehicle moving azimuth at the present time (for example, the own-vehicle moving azimuth when the turn signal starts to be operated, the own-vehicle moving azimuth a predetermined time ago, a provisional reference azimuth). However, the reference azimuth determination unit 73 may determine the reference azimuth to be one of the own-vehicle moving azimuth at the present time and an azimuth having an azimuth angle direction which is different from the turn direction of own-vehicle and is rotated in the turn direction with respect to the own-vehicle moving azimuth.

Although the embodiments of the present disclosure have been described in detail in the above with reference to the accompanying drawings, specific configurations are not limited to those embodiments. Modification, substitution, or deletion may be made without departing from the gist of the present disclosure. Although a specific form of embodiment has been described above and illustrated in the accompanying drawings in order to be more clearly understood, the above description is made by way of example and not as limiting the scope of the invention defined by the accompanying claims. The scope of the invention is to be determined by the accompanying claims. Various modifications apparent to one of ordinary skill in the art could be made without departing from the scope of the invention. The accompanying claims cover such modifications.

We claim:

1. A driving support device comprising:

a communication unit configured to perform communication with another vehicle;

a storage unit configured to store reference information including position information regarding positional relationship of the another vehicle with respect to an own-vehicle, direction information regarding a direction of relative displacement of the another vehicle with respect to the own-vehicle, and a control threshold value, the position information, the direction information and the control threshold being associated with each of classified patterns of encounter situation between the another vehicle and the own-vehicle; and a control unit configured to determine whether the another vehicle encounters the own-vehicle for each of the classified patterns of encounter situation, based on information derived from running information on the another vehicle received by the communication unit and running information on the own-vehicle, and based on the reference information stored by the storage unit, and configured to perform predetermined safety control in accordance with the determination result of whether the another vehicle encounters the own-vehicle, wherein the predetermined safety control instructs the own-vehicle to perform one of generating a warning sound, causing a braking device to output a braking force, and causing a portion which is in constant contact with a driver to vibrate, wherein the position information regarding positional relationship in the reference information includes a range of azimuth of the another vehicle as viewed from a reference azimuth of the own-vehicle and a range of relative distance between the another vehicle and the own-vehicle, wherein the control unit performs the predetermined safety control when an azimuth and a relative distance of the another vehicle each fall within the range of azimuth of the another vehicle and the range of relative distance, the azimuth and relative distance of the another vehicle being derived from the running information on the another vehicle and the running information on the own-vehicle, wherein the control unit is configured to select, as the reference azimuth of the own-vehicle, an own-vehicle moving azimuth at present time to which a central axis of the own-vehicle is presently directed, or different azimuth different from the own-vehicle moving azimuth at the present time, by using information regarding turn of the own-vehicle, and wherein the different azimuth is an azimuth having an azimuth angle direction which is opposite to the direction of the turn of the own-vehicle with respect to the own-vehicle moving azimuth.

2. The driving support device according to claim 1, wherein the reference information is provided for each of classified patterns of encounter situation between the another vehicle and the own-vehicle, and the control unit performs the predetermined safety control based on the reference information for each pattern of encounter situation.

3. A vehicle comprising:

the driving support device according to claim 1; and a collection unit configured to transmit the running information on the own-vehicle to the driving support device.

4. The driving support device according to claim 1, wherein the control unit:

calculates a relative moving direction of the another vehicle, and a relative distance of the another vehicle, with respect to the own vehicle using the running information of the another vehicle and the running information of the own vehicle, determines whether there is possibility of collision between the another vehicle and the own vehicle by detecting that the another vehicle enters a preset area using the relative distance, and if so;

determines whether the possibility of collision is high or not by evaluating correspondence between the relative moving direction of the another vehicle and the reference information.

5. The driving support device according to claim 4, wherein the preset area extends radially from the own vehicle.

6. The driving support device according to claim 1, wherein each of the classified patterns of encounter situation is associated with a plurality of preset areas, and the position information, the direction information and the control threshold are associated with each of the preset areas.

7. A non-transitory computer readable medium storing a control program causing a computer to execute the steps comprising:

performing communication with another vehicle;

storing reference information including position information regarding positional relationship of the another vehicle with respect to an own-vehicle, direction information regarding a direction of relative displacement of the another vehicle with respect to the own-vehicle, and a control threshold value, the position information, the direction information and the control threshold being associated with each of classified patterns of encounter situation between the another vehicle and the own-vehicle; and determining whether the another vehicle encounters the own-vehicle for each of the classified patterns of encounter situation, based on information derived from running information on the another vehicle received in the performing communication and running information on the own-vehicle, and based on the stored reference information, and performing predetermined safety control in accordance with the determination result of whether the another vehicle encounters the own-vehicle, wherein the predetermined safety control instructs the own-vehicle to perform one of generating a warning sound, causing a braking device to output a braking force, and causing a portion which is in constant contact with a driver to vibrate, wherein the position information regarding positional relationship in the reference information includes a range of azimuth of the another vehicle as viewed from a reference azimuth of the own-vehicle and a range of relative distance between the another vehicle and the own-vehicle, wherein the performing step further includes performing the predetermined safety control when an azimuth and a relative distance of the another vehicle each fall within the range of azimuth of the another vehicle and the range of relative distance, the azimuth and relative distance of the another vehicle being derived from the running information on the another vehicle and the running information on the own-vehicle, wherein the determining step includes selecting, as the reference azimuth of the own-vehicle, an own-vehicle moving azimuth at present time to which a central axis of the own-vehicle is presently directed, or different azimuth different from the own-vehicle moving azimuth at the present time, by using information regarding turn of the own-vehicle, and wherein the different azimuth is an azimuth having an azimuth angle direction which is opposite to the direction of the turn of the own-vehicle with respect to the own-vehicle moving azimuth.

8. The non-transitory computer readable medium according to claim 7, wherein each of the classified patterns of encounter situation is associated with a plurality of preset areas, and the position information, the direction information and the control threshold are associated with each of the preset areas.

9. A driving support method comprising:

obtaining running information of another vehicle via communication with the another vehicle using wireless communication device;

obtaining running information of an own vehicle;

calculating, using a computer, a relative moving direction of the another vehicle, and a relative distance of the another vehicle with respect to the own vehicle using the running information of the another vehicle and the running information of the own vehicle;

determining, using the computer, based on information derived from the running information of the another vehicle and the running information of the own-vehicle, and based on reference information stored in a storage device, whether there is possibility of collision between the another vehicle and the own vehicle for each of classified patterns of encounter situation between the another vehicle and the own-vehicle; and performing predetermined safety control when it is determined that there is possibility of collision, wherein the reference information includes position information regarding positional relationship of the another vehicle with respect to the own vehicle, direction information regarding a direction of relative displacement of the another vehicle with respect to the own vehicle, and a control threshold value, the position information, the direction information and the control threshold being associated with each of the classified patterns of encounter situation between the another vehicle and the own-vehicle, wherein the predetermined safety control instructs the own-vehicle to perform one of generating a warning sound, causing a braking device to output a braking force, and causing a portion which is in constant contact with a driver to vibrate, wherein the position information regarding positional relationship in the reference information includes a range of azimuth of the another vehicle as viewed from a reference azimuth of the own-vehicle and a range of relative distance between the another vehicle and the own-vehicle, wherein the performing step further includes performing the predetermined safety control when an azimuth and a relative distance of the another vehicle each fall within the range of azimuth of the another vehicle and the range of relative distance, the azimuth and relative distance of the another vehicle being derived from the running information on the another vehicle and the running information on the own-vehicle, wherein the determining step includes selecting, as the reference azimuth of the own-vehicle, an own-vehicle moving azimuth at present time to which a central axis of the own-vehicle is presently directed, or different azimuth different from the own-vehicle moving azimuth at the present time, by using information regarding turn of the own-vehicle, and wherein the different azimuth is an azimuth having an azimuth angle direction which is opposite to the direction of the turn of the own-vehicle with respect to the own-vehicle moving azimuth.

10. The driving support method according to claim 9 further comprising:

determining whether there is possibility of collision between the another vehicle and the own vehicle by detecting that the another vehicle enters a preset area by using the relative distance, and if so;

determining whether the possibility of collision is high or not by evaluating correspondence between the relative moving direction of the another vehicle and the reference information.

11. The driving support method according to claim 10, wherein the preset area extends radially from the own vehicle.

12. The driving support method according to claim 9, wherein each of the classified patterns of encounter situation is associated with a plurality of preset areas, and the position information, the direction information and the control threshold are associated with each of the preset areas.

* * * * *